US008820735B2

(12) United States Patent
Ishikawa et al.

(10) Patent No.: US 8,820,735 B2
(45) Date of Patent: Sep. 2, 2014

(54) SHEET STORING APPARATUS

(71) Applicants: Mitsunori Ishikawa, Tokyo (JP); Hideki Mimura, Yamanashi-ken (JP)

(72) Inventors: Mitsunori Ishikawa, Tokyo (JP); Hideki Mimura, Yamanashi-ken (JP)

(73) Assignees: Riso Kagaku Corporation, Tokyo (JP); Nisca Corporation, Minamikoma-gun, Yamanashi-ken (JP)

( * ) Notice: Subject to any disclaimer, the term of this patent is extended or adjusted under 35 U.S.C. 154(b) by 0 days.

(21) Appl. No.: 14/056,506

(22) Filed: Oct. 17, 2013

(65) Prior Publication Data

US 2014/0110896 A1 Apr. 24, 2014

(30) Foreign Application Priority Data

Oct. 22, 2012 (JP) ..... 2012-233227

(51) Int. Cl.

| | |
|---|---|
| ***B65H 29/70*** | (2006.01) |
| ***B65H 5/26*** | (2006.01) |
| ***B65H 5/06*** | (2006.01) |
| ***B65H 1/08*** | (2006.01) |

(52) U.S. Cl.

CPC ..... *B65H 5/26* (2013.01); *B65H 5/068* (2013.01); *B65H 1/08* (2013.01)

USPC ..... 271/188; 271/209

(58) Field of Classification Search

CPC ..... B65H 29/70; B65H 29/14; B65H 2301/5122; B65H 2301/51256; G03G 15/6576; G03G 2215/00662

USPC ..... 271/188, 209; 399/406

See application file for complete search history.

(56) References Cited

U.S. PATENT DOCUMENTS

| | | | | |
|---|---|---|---|---|
| 5,414,503 | A * | 5/1995 | Siegel et al. | 399/406 |
| 2008/0310900 | A1* | 12/2008 | Lee | 399/406 |
| 2010/0143014 | A1* | 6/2010 | Kim et al. | 399/406 |

FOREIGN PATENT DOCUMENTS

| | | | |
|---|---|---|---|
| JP | 3604262 | B2 | 12/2004 |
| JP | 2009-035371 | A | 2/2009 |
| JP | 4591579 | B2 | 12/2010 |

* cited by examiner

*Primary Examiner* — Michael McCullough

(74) *Attorney, Agent, or Firm* — Manabu Kanesaka

(57) ABSTRACT

Provided is a sheet storing apparatus including a processing tray and a stack tray arranged respectively at the downstream side of a path sheet discharging port of a sheet discharging path and at the downstream side of the processing tray as forming a step respectively, and a reversing roller arranged at a tray sheet discharging port as being capable of rotating forwardly and reversely to convey a sheet conveyed from the path sheet discharging port selectively to the processing tray and the stack tray, so that a sheet to be conveyed to the processing tray from the path sheet discharging port is conveyed in a state of having corrugations formed thereon and a sheet to be conveyed to the stack tray from the sheet discharging port is stored at the stack tray in a flat shape as having the corrugations corrected after passing through the reversing roller.

12 Claims, 11 Drawing Sheets

SHEET STORING APPARATUS

The present application claims the benefit of priority of Japanese Patent Application No. 2012-233227 filed Oct. 22, 2012 which is incorporated herein by reference in its entirety.

BACKGROUND OF THE INVENTION

1. Field of the Invention

The present invention relates to a sheet storing apparatus which stores image-formed sheets on a stack tray after performing a post-processing such as a binding process while stacking the sheets temporarily on a processing tray and a sheet aligning mechanism which stacks sheets on the stack tray in an orderly manner.

2. Description of Related Arts

In general, there has been widely known a sheet storing apparatus which stacks and stores sheets with images formed thereon by an image forming apparatus on a stack tray. Among such storing apparatuses, there has been also known a sheet storing apparatus which has a function of performing a post-processing such as a binding process while temporarily stacking sheets conveyed to a sheet discharging port on a processing tray which is arranged between a sheet discharging path and a sheet placement face of a stack tray and subsequently storing the sheets on the stack tray.

For example, Japanese Patent Application Laid-Open No. 2009-35371 (Patent Document 1) discloses an apparatus in which a sheet conveyed from an image forming apparatus is introduced to a sheet discharging path, a processing tray is arranged at the downstream side of a path sheet discharging port with a step therefrom, and a stack tray is arranged at the lower side thereof with a step further therefrom. Patent Document 1 also discloses a conveyance switching mechanism in which a reversing roller capable of being rotated forwardly and reversely is arranged at a position distanced from the sheet discharging port of the sheet discharging path, a leading end of a sheet conveyed from the sheet discharging port is received by a reversing roller, and reverse rotation of the roller conveys the sheet to the processing tray and forward rotation of the roller conveys the sheet to the stack tray.

Thus, the sheet conveyed from the sheet discharging path is stored at the stack tray as being conveyed in the sheet discharging direction and is stored at the processing tray as being conveyed in the direction opposite to the sheet discharging direction. With such a path configuration, a predetermined distance is formed between the sheet discharging port of the sheet discharging path and an introducing port of the stack tray. In the apparatus of Patent Document 1, a space is formed between the sheet discharging port of the sheet discharging path and the reversing roller and the processing tray is arranged therebelow. This is to arrange a large distance (space) between the sheet discharging port and the reversing roller and to arrange the processing tray therebelow for miniaturization and compactification of the apparatus.

Here, in order to reliably convey a sheet to a reversing roller which is distanced from a sheet discharging port of a sheet discharging path, there has been known to form a plurality of corrugated-plate-shaped corrugations in the sheet width direction on a sheet conveyed by a sheet discharging roller, traditionally.

Japanese Patent No. 4591579 (Patent Document 2) discloses a sheet discharging mechanism in which a guide rib protruded between roller nipping points is arranged between sheet discharging roller pairs which are arranged at a predetermined interval to form concavo-convex corrugations on a sheet conveyed from a sheet discharging roller. Such a sheet discharging mechanism reinforces a sheet which is difficult to be conveyed in a linear direction such as a soft thin sheet and a curled sheet by forming corrugations in a direction perpendicular to the sheet conveying direction thereon. According to the above, the sheet conveyed by the sheet discharging roller is conveyed farther to the downstream side on a linear trajectory.

Similarly, in Japanese Patent No. 3604262 (Patent Document 3), a guide rib protruded between rollers is arranged at the upstream side of the sheet discharging roller pairs which is arranged in plural lines as being mutually distanced to form a plurality of corrugations on a sheet and a guide plate arranged at the roller downstream side presses the sheet to correct curls thereof. According to the above, a conveyance force is reliably provided to a sheet nipped by the roller pair and the sheet is corrected thereafter.

SUMMARY OF THE INVENTION

As described above, there has been known a sheet storing apparatus in which a processing tray is arranged at the downstream side of a sheet discharging path, a stack tray is arranged at the downstream side thereof, and a sheet conveyed from the sheet discharging path is conveyed selectively to the processing tray and the stack tray. In such an apparatus, generally, a large distance is formed between a sheet discharging port of the sheet discharging path and a sheet discharging port of the processing tray so that a space for arranging the processing tray is reduced. In this case, a large space in which a part of the processing tray is arranged is formed between a reversing roller arranged at the sheet discharging port of the processing tray and the sheet discharging port of the sheet discharging path.

Here, a sheet conveyed from the sheet discharging port is conveyed with jumping of the leading end thereof to a reversing roller at the downstream side. Accordingly, a sheet such as a curled sheet, a thin sheet, and a soft sheet causes sheet jamming before the leading end thereof arrives at the reversing roller.

As illustrated in Patent Documents 2 and 3, there has been known a configuration in which a sheet discharging roller is structured with a plurality of roller pairs which are mutually distanced and a corrugation rib which deforms a sheet in a concavo-convex manner is arranged between the rollers to reinforce a sheet passing through the sheet discharging roller into a corrugated-plate shape. In addition to the above, there has been also known a guide configuration to correct the reinforced and deformed sheet into a flat shape.

By the way, with the storing mechanism in which the processing tray and the stack tray are arranged at the downstream side of the sheet discharging port as forming a step respectively, sheets conveyed to the processing tray are required to be aligned as being reliably abutted to a predetermined stopper. Here, there is a problem that a sheet such as a curled sheet and a soft sheet causes a sheet jamming, sheet skewing, and resisting.

On the other hand, when a sheet is discharged from a sheet discharging path onto a sheet placement face of the stack tray, a reinforced sheet to be introduced may cause positional shifting of a sheet previously placed on the sheet placement face. Further, when a sheet is discharged with reinforcement remained thereon, the sheet may not be placed at an accurate position owing to disturbed behavior of the sheet. Thus, it is difficult to convey a variety of sheets such as a thick sheet and a thin sheet stably and reliably from the sheet discharging port to the processing tray and the stack tray.

In such a situation, the present inventors have come up with an idea to convey a sheet in a state that corrugations are formed thereon when conveying the sheet from the sheet discharging port of the sheet discharging path to a regulation position of the processing tray and to convey a sheet on the uppermost sheet on the sheet placement face in a state that corrugations are corrected when conveying the sheet to the stack tray.

The present invention provides a sheet storing apparatus capable of stacking sheets reliably and stably at defined positions set respectively at a processing tray and a stack tray when conveying the sheets from the sheet discharging path to both the trays.

In order to solve the abovementioned problems, in the present invention, a processing tray and a stack tray are arranged respectively at the downstream side of a path sheet discharging port of a sheet discharging path and at the downstream side of the processing tray as forming a step respectively, and a reversing roller capable of being rotated forwardly and reversely to convey a sheet conveyed from the path sheet discharging port selectively to the processing tray and the stack tray is arranged at a tray sheet discharging port. A sheet to be conveyed to a processing position of the processing tray from the path sheet discharging port is conveyed in a state of having corrugated-plate-shaped corrugations formed thereon. A sheet to be conveyed to the stack tray from the sheet discharging port is stored on a sheet placement face in a flat shape as having the corrugations corrected by de-curling means after passing through the reversing roller.

According to the above, a sheet is reliably conveyed with influence of corrugations to the reversing rotor which is distanced from the path sheet discharging port, and then, is conveyed to a processing position of the processing tray in a state that the corrugations are formed. Further, the sheet conveyed to the reversing roller with influence of the corrugations is stored at the stack tray after being corrected into a flat shape at the downstream side thereof. Accordingly, it is possible to avoid positional shifting of a sheet stored on the sheet placement face. Further, a discharged sheet is stored at an accurate placement position.

In the present invention, corrugations having a corrugated-plate shape are formed over a wide range in the sheet width direction on a sheet to be discharged from the sheet discharging path. The sheet is conveyed to the reversing roller in a state of being reinforced and the reinforced sheet is conveyed to the processing tray and positioning thereof is performed. Then, the sheet is to be stored at the stack tray through the reversing roller while vanishing the corrugations. According to the above, following effects are obtained.

A sheet to be discharged from the sheet discharging path to the path sheet discharging port is reinforced over the entire range in the sheet width direction by the corrugation forming means and a plurality of roller pairs which are mutually distanced in the direction perpendicular to the sheet discharging direction. Accordingly, the sheet is provided with a conveyance force reliably by the sheet discharging roller pairs and is vigorously discharged through the sheet discharging port. Therefore, the sheet is passed to the reversing roller without causing sheet jamming even if the reversing roller is arranged at a position being relatively distanced therefrom.

The rollers are formed to provide a narrow engagement width of engagement between the sheet conveyed as described above and the reversing roller. Accordingly, corrugations formed at sheet end sections other than the section engaged with the rollers are naturally vanished. Then, the sheet is conveyed to a predetermined position (e.g., binding process position) of the processing tray with the corrugation formed between reversing rollers.

Owing to that the conveying roller is structured with a plurality of roller pairs and the reversing roller is structured with two roller pairs, the number of corrugations can be reduced with a simple configuration.

Owing to that the de-curling means has a width to cover the reversing roller distance, reinforcement can be corrected even if variations occur at the corrugations.

Owing to that the de-curling means has a width being approximately the same as that of the reversing roller including the roller distance, reinforcement can be corrected more reliably.

Owing to that the de-curling means provides surface contact with a sheet, contact pressure against the sheet can be reduced compared to a case of point contact. Further, owing to that an idling roller is arranged at the de-curling means, friction with a sheet can be reduced.

Further, a sheet conveyed to the stack tray as passing through the reversing roller is introduced onto the uppermost sheet on the sheet placement face as being de-curled into a flat shape at the downstream side of the reversing roller. Since the sheet to be introduced is in a state of being unreinforced, the sheet is stored at an accurate placement position without causing positional shifting of stacked sheets.

Further, owing to a configuration in which the second conveying roller is capable of being apart and contacted and the second conveying roller and the de-curling means are integrally lifted and lowered, a sheet passing through the processing tray reliably arrives at the second conveying roller in a state of being reinforced and is conveyed to the processing tray.

Owing to being reinforced, the sheet is reliably positioned on the processing tray. Owing to arranging stapling means at the processing tray, a binding process can be performed at an accurate position.

Further, a sheet can be discharged with minimum reinforcement. In addition, discharging can be performed while the de-curling means is arranged as having a minimum width in the sheet width direction.

BRIEF DESCRIPTION OF THE DRAWINGS

FIGS. 3A and 3B are explanatory views illustrating a structure of a reversing mechanism which performs reverse conveying of a sheet conveyed from a sheet discharging path in FIG. 2; while FIG. 3A is an explanatory view of a sectional structure and FIG. 3B is an explanatory view of a plane structure;

FIGS. 4A to 4C are explanatory views of operation states of the reversing mechanism illustrated in FIGS. 3A and 3B; while FIG. 4A illustrates a waiting state in which a reversing roller is separated, FIG. 4B illustrates a switch-back conveyance state in which a sheet is introduced to a processing tray, and FIG. 4C illustrates a sheet discharge state in which a sheet is conveyed to a stack tray;

FIGS. 6A to 6C are explanatory views of a configuration of a sheet discharging section illustrated in FIG. 3A; while FIG. 6A is an explanatory view illustrating a sheet discharging mechanism, FIG. 6B is an explanatory view illustrating a configuration of corrugation forming means, and FIG. 6C is an explanatory view illustrating a configuration of de-curling means;

FIGS. 8A to 8C are explanatory views illustrating a sectional structure of the corrugation forming means and the de-curling means; while FIG. 8A is a sectional view at X-X in FIG. 7, FIG. 8B is a sectional view at Y-Y in FIG. 7, and FIG. 8C is a sectional view at Z-Z in FIG. 7;

FIGS. 9A to 9C are explanatory views illustrating operation states of the corrugation forming means and the de-curling means; while FIG. 9A illustrates a state in which a sheet reinforced by the corrugation forming means is conveyed from a first sheet discharging port to a second sheet discharging port, FIG. 9B illustrates a state in which the reinforced sheet is positioned to a regulating stopper of the processing tray, and FIG. 9C illustrates a state in which the sheet conveyed to the second sheet discharging port is stored at the stack tray;

DETAILED DESCRIPTION OF THE PREFERRED EMBODIMENT

[Image Forming System]

Figure 1:
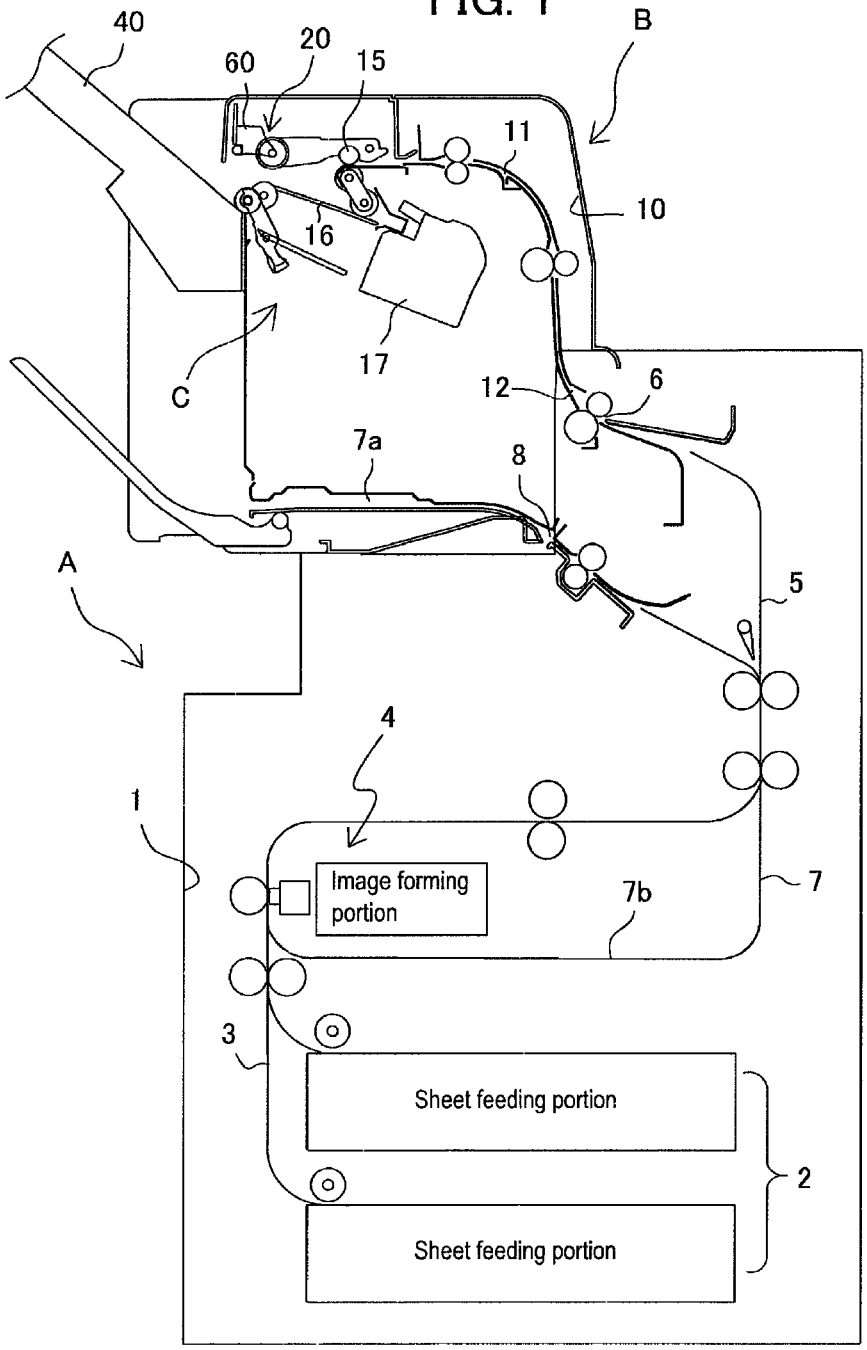
FIG. 1 is an explanatory view illustrating a whole configuration of an image forming system according to the present invention.

In the following, the present invention will be described in detail based on preferred embodiments illustrated in the drawings. FIG. 1 illustrates an image forming system. The image forming system includes an image forming apparatus A which forms an image on a sheet and a post-processing apparatus B which performs a post-process such as a binding process of collating and stacking sheets with images formed thereon. A sheet storing apparatus C according to the present invention is built into the post-processing apparatus B. In the following, description will be performed on the image forming apparatus and the post-processing apparatus in the order thereof.

[Image Forming Apparatus]

The image forming apparatus A illustrated in FIG. 1 is connected to an image managing device such as a computer and a network scanner (not illustrated). The image forming apparatus A forms an image on a specified sheet based on image data transferred from such a device and discharges the sheet through a predetermined discharge port (later-mentioned sheet discharging port). Other than constituting such a network configuration, the image forming apparatus A is structured as a copying machine or a facsimile machine and copies and forms an image on a sheet based on image date read by a document scanning unit.

In the image forming apparatus A, a plurality of sheet feeding cassettes 2 are arranged at a housing 1. A sheet of a selected size is fed from the corresponding cassette to a sheet feeding path 3 located at the downstream side. An image forming mechanism (image forming portion) 4 is arranged at the sheet feeding path 3. A variety of types such as an ink-jet printing mechanism, an electrostatic printing mechanism, an offset printing mechanism, a silk-screen printing mechanism, and a ribbon-transfer printing mechanism have been known as the image forming mechanism 4. The present invention may be applied to any of the above printing mechanism.

A sheet discharging path 5 is arranged at the downstream side of the image forming mechanism 4. A sheet is discharged through a sheet discharging port 6 (hereinafter, called a body sheet discharging port) which is arranged at the housing 1. Here, in some printing mechanisms, a fixing unit (not illustrated) is built into the sheet discharging path 5. Thus, a sheet of a selected size is fed from the sheet feeding cassette 2 to the image forming portion 4, and then, is discharged through the body sheet discharging port 6 from the sheet discharging path 5 after an image is formed thereon.

Further, a duplex path 7 is arranged in the housing 1. According to the duplex path 7 for duplex printing, a sheet is face-reversed and fed again to the image forming portion 4 after an image is formed on a front face of the sheet at the image forming portion 4, and then, the sheet is discharged through the body sheet discharging port 6 after an image is formed on a back face thereof. The duplex path 7 includes a switch-back path 7*a* on which a conveying direction of a sheet fed from the sheet discharging path 5 is reversed, and a U-turn path 7*b* on which the sheet fed from the switch-back path 7*a* is face-reversed. A connecting port 8 arranged at the housing 1 connects the duplex path 7 to the switch-back path 7*a* arranged at the post-processing apparatus B.

In the apparatuses illustrated in FIG. 1, the switch-back path 7*a* is built into the post-processing apparatus B and the U-turn path 7*b* is built into the image forming apparatus A. Switching-back (conveying direction reversing) of a sheet fed from the sheet discharging path 5 requires a path length corresponding to the maximum sheet size. Owing to that the path is arranged by utilizing a space in the post-processing apparatus B, the entire apparatus is downsized.

The switch-back path 7*a* includes a linear path and a guide tray. The linear path is arranged at a bottom part of post-processing means (staple unit) 17 of the post-processing apparatus B (described later). The guide tray is structured as being connected to the linear path and being protruded outward from a housing 10 of the post-processing apparatus B.

Being different from the illustrated apparatus configuration, it is also possible to adopt a configuration in which a scanner unit and a document feeding unit which feeds a document sheet to the scanner unit are integrally assembled to the housing 1. The scanner unit in the above case performs scanning to read an image of a document sheet which is placed on a platen or fed from a feeder mechanism (ADF), and then, transfers the read data to the image forming apparatus A. Further, the document feeding unit includes the feeder mechanism which feeds a document sheet onto the platen of the scanner unit.

[Post-Processing Apparatus]

The post-processing apparatus B illustrated in FIG. 2 includes the housing 10, a sheet conveying path (hereinafter, called a sheet discharging path) 11 which is built into the housing 10, a processing tray 16, and a stack tray 40. Configurations of the above will be described in the following.

[Sheet Conveying Path (Sheet Discharging Path)]

The sheet discharging path 11 includes an introducing port 12 which is connected to the body sheet discharging port 6 of the abovementioned image forming apparatus A, and a path sheet discharging port 13*a* (hereinafter, also called a first sheet discharging port) illustrated in FIG. 2. Here, a sheet with an image formed thereon is introduced into the post-processing apparatus B from the introducing port 12 and is discharged through the path sheet discharging port 13*a*. The processing tray 16 and the stack tray 40 are arranged at the downstream side of the path sheet discharging port 13*a* as forming steps (dh1 and dh2 illustrated in FIG. 6A). Then, the sheet introduced from the introducing port 12 is conveyed selectively to the processing tray 16 and the stack tray 40 at the downstream side of the sheet discharging path 11.

Figure 2:
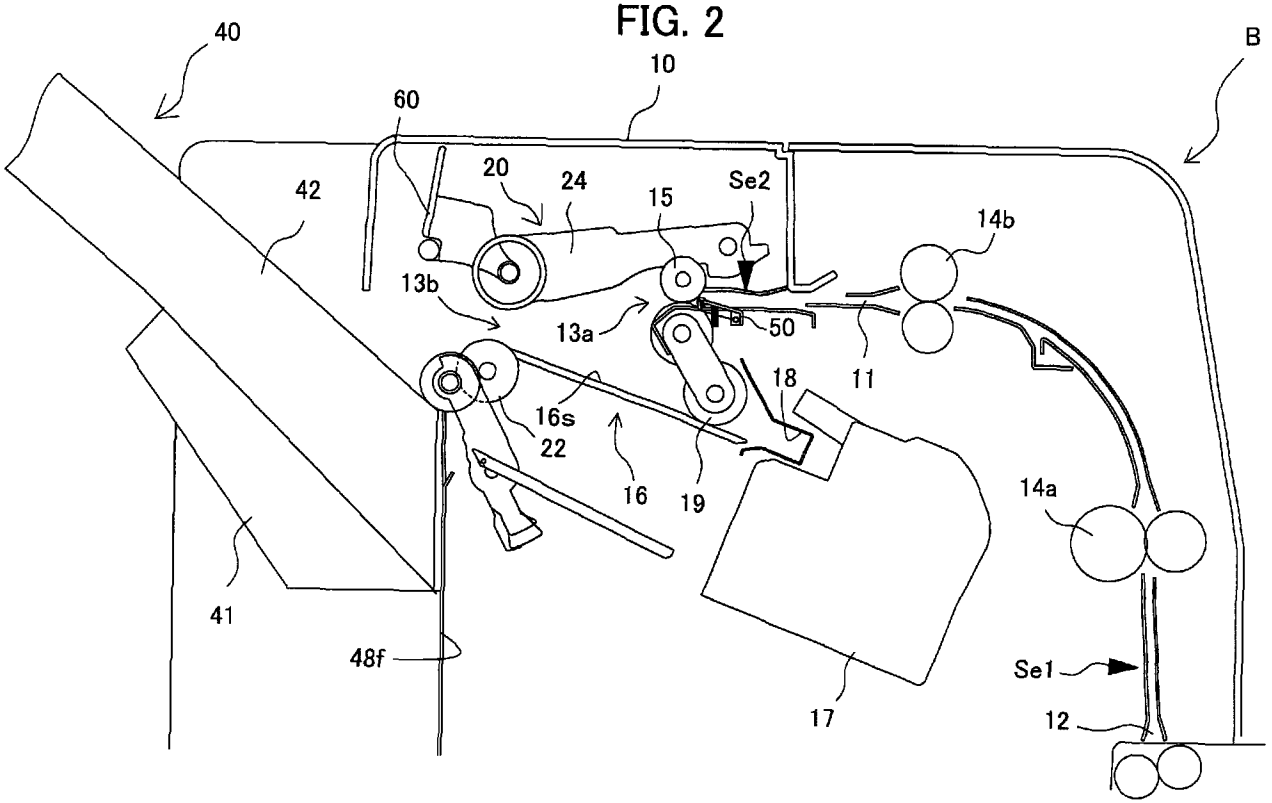
FIG. 2 is an explanatory view of a structure of a post-processing apparatus illustrated in FIG. 1.

An introduction sensor Se1 to detect a sheet leading end (and/or a sheet tailing end) is arranged at the introducing port 12 of the sheet discharging path 11 and a discharge sensor Se2 to detect a sheet leading end and a sheet tailing end is arranged at the path sheet discharging port 13*a* (see FIG. 2). Further, conveying rollers 14*a*, 14*b* to convey a sheet are arranged on the sheet discharging path 11 at an appropriate interval. A sheet discharging roller 15 is arranged at the outlet end of the sheet discharging path 11. The structure of the sheet discharging roller 15 will be described later.

Each of the conveying rollers 14*a*, 14*b* and the sheet discharging roller 15 is structured with a plurality of roller series as being mutually distanced in the sheet width direction (the direction perpendicular to the sheet discharging direction). Each roller is structured with a pair of rollers which are mutually pressure-contacted to nip a sheet and to apply a conveyance force to the sheet.

Further, the sheet discharging path 11 includes an appropriately linear path as laterally extending in the housing 10 approximately in the horizontal direction. The processing tray 16 and the stack tray 40 are arranged as described below at the downstream side of the path sheet discharging port 13*a* of the sheet discharging path 11.

[Processing Tray]

As illustrated in FIG. 2, the processing tray 16 is arranged at the downstream side of the path sheet discharging port 13*a* as forming a step (dh1 illustrated in FIG. 6A) therefrom. The processing tray 16 is provided with a sheet placement base 16*s* on which sheets are stacked and supported, a regulating stopper 18 which performs positioning of sheets at a processing position on the sheet placement base 16*s*, and the post-processing means 17 (stable unit in FIG. 2). Further, aligning means (not illustrated) which biases and aligns sheets to reference in the width direction (side reference plate) is arranged at the sheet placement base 16.

The sheet placement base 16*s* is arranged at a position enabling to perform reverse conveying (switch-back conveying) of a sheet from the path sheet discharging port 13*a* to a processing position. According to the above, a sheet conveyed to the path sheet discharging port 13*a* is supported (bridge-supported) as a leading end part thereof being supported by the later-mentioned stack tray 40 (onto the uppermost sheet) and a tailing end part thereof being supported by the sheet placement base 16*s*, so that apparatus downsizing is achieved.

Further, the regulating stopper 18 which performs regulation with abutting against a sheet tailing end and an aligning mechanism (not illustrated) which biases and aligns sheets in a direction perpendicular to the sheet discharging direction are arranged at the sheet placement base 16*s*. Since a variety of mechanisms have been known as such an aligning mechanism, detailed description thereof is skipped. Sheets introduced onto the processing tray 16 are positioned according to preset reference (center reference or side reference). FIG. 2 illustrates the apparatus in a case of aligning to the center reference.

A staple unit which performs a binding process of a collated and stacked sheet bundle is arranged at the sheet placement base 16*a* as the post-processing means 17. The staple unit (post-processing means) 17 has been known as a device which bends a linear needle into a U-shape, inserts the staple needle to the sheet bundle from an uppermost sheet face to a lowermost sheet face as bending leading ends of the staple needle. Other than the staple unit, a sheet holding unit, a punch unit, a stamp unit, a trimmer unit, or the like (not illustrated) is adopted as the post-processing means 17 in accordance with apparatus specifications.

The later-mentioned stack tray 40 is arranged at the downstream side of the processing tray 16 in the sheet discharging direction. A tray sheet discharging port 13*b* (hereinafter, also called a second sheet discharging port) through which a sheet is discharged to the stack tray 40 is arranged at the processing tray 16. A distance L1 (see FIGS. 6A and 9A) is formed between the path sheet discharging port 13*a* and the tray sheet discharging port 13*b*. A reversing roller mechanism 20 is arranged between both the discharging ports 13*a*, 13*b* which are arranged as being aligned in the sheet discharging direction.

The reversing roller mechanism 20 conveys a sheet fed to the path sheet discharging port 13*a* to the downstream side in the sheet discharging direction and reverses the conveying direction at the time when the sheet tailing end passes through the path sheet discharging port 13*a*. Accordingly, the sheet is reversed and guided to the processing tray 16 with the tailing end thereof falling by the step dh1. Then, the sheet is abutted to the regulating stopper 18 by a later-mentioned friction rotor 19 and is stopped at the position thereof (in a case of a later-mentioned first sheet discharge mode).

The friction rotor 19 which guides the sheet to the regulating stopper 18 in cooperation with the reversing roller mechanism 20 arranged at the path sheet discharging port 13*a* is arranged at the processing tray 16. In FIG. 2, the friction rotor 19 is arranged at a position to be engaged with a stacked sheet on the sheet placement base 16*s*. The friction rotor 19 is structured with a raking roller (or belt) and is driven by a drive belt to be rotated integrally with a sheet discharging roller 15. Then, the friction rotor 19 is engaged with a stacked sheet owing to own weight. The sheet reversely conveyed from the reversing roller 20 with rotation of the friction rotor 19 being the raking roller is conveyed to the regulating stopper 18 and is stopped as being abutted thereto.

[Reversing Roller Mechanism]

Figure 3A:
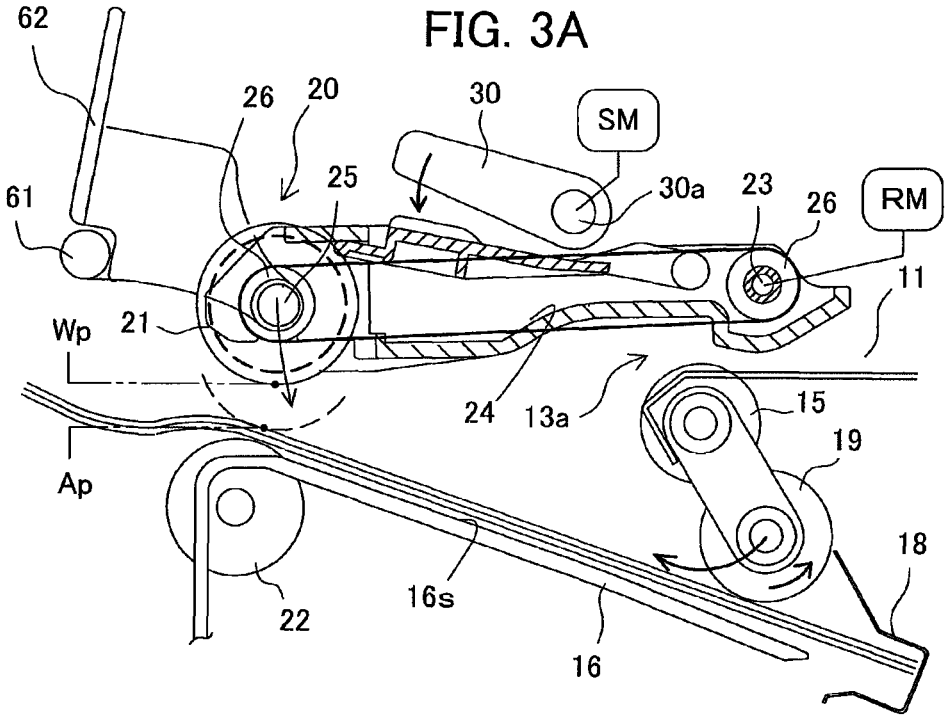
Figure 3B:
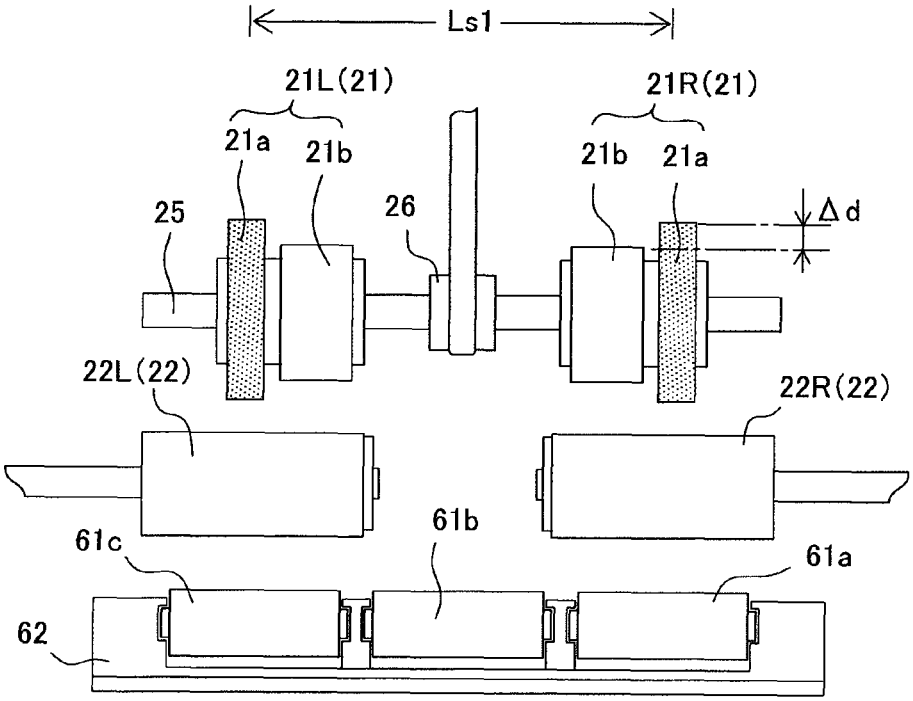

FIGS. 3A and 3B are explanatory views of the reversing roller mechanism 20. FIG. 3A illustrates a sectional structure and FIG. 3B illustrates a plane structure. The reversing roller mechanism 20 is structured with a right-left pair of rollers 21 (21R, 21L), 22 (22R, 22L) arranged at the center in the width direction of a sheet fed to the path sheet discharging port 13*a* as being distanced by a distance Ls1 (see FIG. 3B). The reversing roller mechanism 20 selectively performs a first sheet discharging operation in which the sheet fed from the path sheet discharging port 13*a* is introduced to the processing tray 16 with the conveying direction reversed after being conveyed in the sheet discharging direction and a second sheet discharging operation in which the sheet fed from the path sheet discharging port 13*a* is conveyed in the sheet discharging direction and is stored at the stack tray 40.

Accordingly, the reversing roller mechanism 20 is arranged at the tray sheet discharging port 13*b* of the processing tray 16 at the downstream side of the path sheet discharging port 13*a*. In the first discharging operation, the roller is reversely rotated in the opposite direction to the sheet discharging direction after being forwardly rotated in the sheet discharging direction. In the second discharging operation, the roller is rotated only in the sheet discharging direction, so that the sheet fed from the path sheet discharging port 13*a* is conveyed from the tray sheet discharging port 13*b* to the stack tray 40.

The reversing roller mechanism 20 is structured with an upper roller 21 which is engaged with a sheet upper face and a lower roller 22 which is engaged with a sheet lower face. In FIG. 3B, the upper roller 21 and the lower roller 22 are structured respectively with the rollers 21R, 21L and rollers 22R, 22L being the right-left pair at the sheet center as being distanced by the distance Ls1. Further, the upper roller 21 is swingably supported by an apparatus frame F as being capable of being lifted and lowered between an operation position Ap to be pressure-contacted to the lower roller 22 and a waiting position Wp to be apart therefrom (see FIG. 3A).

A roller drive motor RM being a forward-reverse motor is connected to the upper roller 21 as illustrated in FIG. 3A. Accordingly, the upper roller 21 (21R, 21L) is capable of being rotated as being switched between the sheet discharging direction (clockwise direction in FIG. 3A) and an opposite direction to the sheet discharging direction (counterclockwise direction in FIG. 3A).

A right-left pair of roller brackets (swing arms) 24 is supported by the apparatus frame F as being swingable about a swing pivot 23. A roller rotary shaft 25 is rotatably bearing-supported by the pair of roller brackets 24. The upper roller 21 is fitted to the rotary shaft 25. The swing pivot 23 is supported by the apparatus frame F (see FIG. 5) rotatably or fixedly. The roller bracket 24 is fitted to the swing pivot 23 directly or via a collar member.

According to the above, a bracket base end portion is supported about the swing pivot 23 swingably to a direction of an arbitral angle. Further, a collar member (rotary collar) is loosely fitted to the swing pivot 23 and a drive pulley 26 which transmits rotation to the rotary shaft 25 of the upper roller 21 is connected to the collar member. The roller drive motor RM is connected to the drive pulley 26.

Figure 4A:
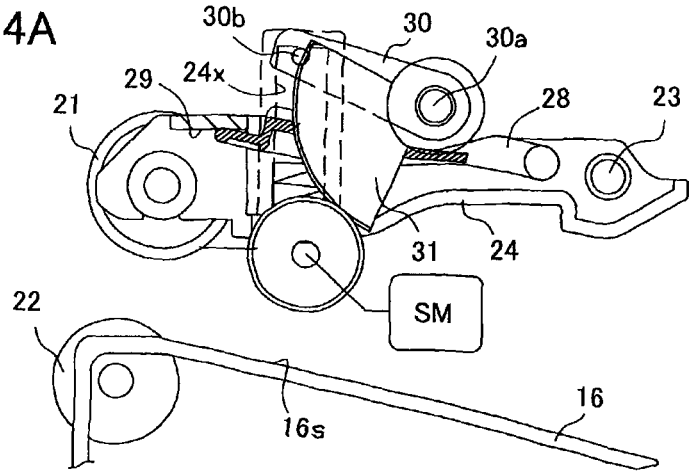
Figure 4B:
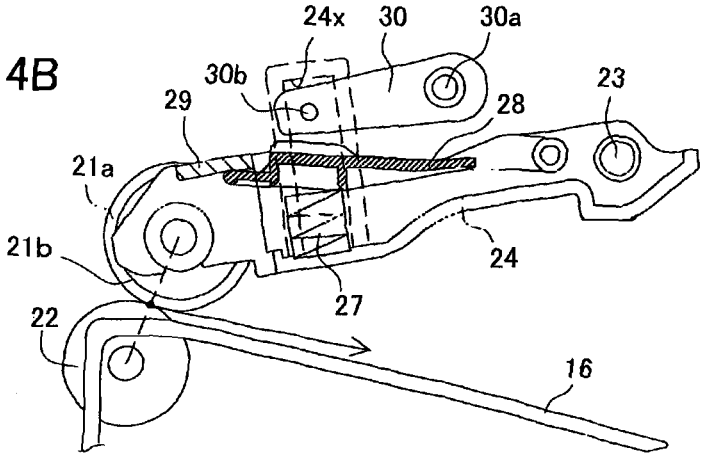
Figure 4C:
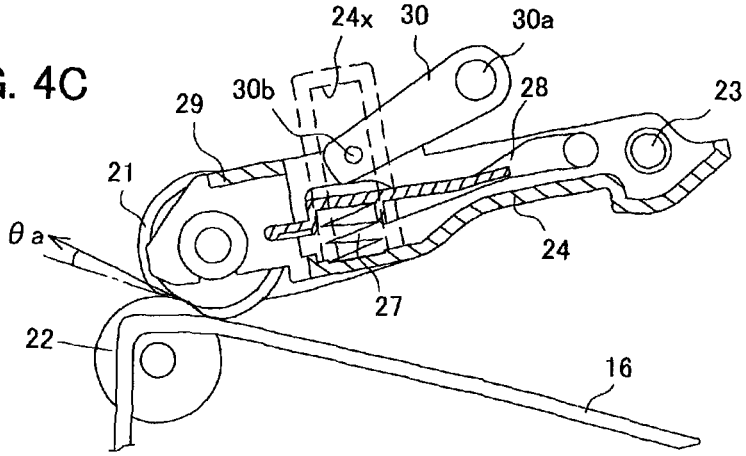

The roller bracket 24 is provided with a lifting-lowering mechanism which performs lifting-lowering motion between the waiting position Wp where the upper roller 21 is apart from the lower roller 22 and the operating position Ap where the upper roller 21 is pressure-contacted to the lower roller 22. FIGS. 4A to 4C illustrate the lifting-lowering mechanism. As illustrated in FIG. 4A, a lifting-lowering lever 30 is arranged within a movement trajectory of the roller bracket 24 which swings about the swing pivot 23. A base end portion of the lifting-lowering lever 30 is swingably supported by a rotary shaft 30*a*. The rotary shaft 30*a* is connected to a lifting-lowering motor SM via a sector-shaped gear 31. Accordingly, the lifting-lowering lever 30 is configured to be rotated (swung) within a predetermined angle range owing to rotation of the lifting-lowering motor SM.

An operation pin 30*b* is integrally formed at a top end portion of the lifting-lowering lever 30. An engagement receiving portion (long groove) 24*x* which is engaged with the operation pin 30*b* is formed at the roller bracket 24. When the operation pin 30*b* is engaged with the engagement receiving portion 24*x* as illustrated in FIG. 4A, the roller bracket 24 is located at the waiting position. When the operation pin 30*b* is in a state of being apart from the engagement receiving portion 24*x*, the roller bracket 24 is located at the operating position where the upper roller 21 is pressure-contacted to the lower roller 22 owing to own weight (in the state of FIG. 4B).

Further, when the operation pin 30*b* depresses a movable bar 28, a pressurizing spring 27 is compressed and a spring force thereof is added to the roller bracket 24 as a pressure-contact force between the upper roller 21 and the lower roller 22 (in the state of FIG. 4C). Thus, when the lifting-lowering lever 30 is displaced owing to angle control of the lifting-lowering motor SM from the state of FIG. 4A to states of FIGS. 4B and 4C, the upper roller 21 shifts from a state of being apart from the lower roller 22 to a state of being pressure-contacted thereto with a low pressurization force and a state of being pressure-contacted thereto with a high pressurization force. A stopper piece 29 in FIGS. 4A to 4C is arranged at the roller bracket 24 to restrict the upper limit of swing motion of the movable bar 28.

According to the above configuration, when the lifting-lowering motor SM rotates in a predetermined direction (clockwise direction in FIG. 4A), the lifting-lowering lever 30 illustrated in FIG. 4A moves to lift the roller bracket 24 in a direction in which the upper roller 21 is to be apart from the lower roller 22. Accordingly, the roller bracket 24 is lifted and moved to the waiting position as being engaged with a stopper (not illustrated) and held at the waiting position with loads of the motor, a transmitting mechanism, and the like. When the lifting-lowering motor SM rotates in the opposite direction, the lifting-lowering lever 30 rotates in the counterclockwise direction in FIG. 4B. Accordingly, the roller bracket 24 rotates about the swing pivot 23 in a direction to drop (fall) owing to own weight, so that the upper roller 21 is pressure-contacted to the lower roller 22.

Along with roller lifting-lowering, the roller drive motor RM transmits rotation to the upper roller 21. The roller drive motor RM is structured with a motor capable of rotating forwardly and reversely. In this case, the upper roller 21 is controlled to perform the first sheet discharging operation and the second sheet discharging operation as described in the following.

According to the first sheet discharging operation, the upper roller 21 is rotated in the sheet discharging direction in a state of being pressure-contacted to the lower roller 22 to discharge a sheet through the path sheet discharging port 13*a* (see FIG. 2). When the leading end of the sheet proceeds to the roller nipping section, the sheet is conveyed in the sheet discharging direction as receiving conveyance forces from both of the sheet discharging roller 15 (see FIG. 2) and the reversing roller 20.

Next, when the tailing end of the sheet left from the path sheet discharging port 13*a* (right after occurrence of a detection signal of the discharge sensor Se2 (see FIG. 2)), the rotating direction of the upper roller 21 is reversed. Accordingly, at the same time when the sheet tailing end drops from the path sheet discharging port 13*a* to the processing tray 16, the sheet leading end is reversely conveyed by the upper roller 21. This sheet discharging method is adopted for control when a first sheet is introduced to the processing tray 16 (when friction between sheets does not exist). Here, the pressure-contact force between the upper roller 21 and the lower roller 22 is set as the high pressurization force (in the state of FIG. 4C).

According to the second sheet discharging operation, when a preceding sheet is already stacked on the lower roller 22, it is in a waiting state for a sheet to be discharged through the path sheet discharging port 13*a* while the upper roller 21 is kept at the waiting position Wp. At the timing when the tailing end of the sheet is fed out through the path sheet discharging port 13*a*, the upper roller 21 is lowered from the waiting position Wp to the operating position Ap. Along with the roller lowering action, the roller drive motor RM is rotated in the direction opposite to the sheet discharging direction. Accordingly, the tailing end of the sheet fed out through the path sheet discharging port 13*a* drops to the processing tray 16 and the sheet is conveyed with the tailing end side in the lead toward the regulating stopper 18 with the conveyance force received from the upper roller 21. Here, the pressure-contact force between the upper roller 21 and the lower roller 22 is set to the low pressurization force (in the state of FIG. 4B).

In the abovementioned configuration, the upper roller 21 is lifted and lowered among the waiting position, the pressure-contact position with low pressurization, and the pressure-contact position with high pressurization by the lifting-lowering lever 30 separately arranged from the roller bracket 24 around the swing pivot 23. Alternatively, it is possible to arrange a spring clutch at the swing pivot 23 of the roller bracket 24 and to rotate a rotary shaft (rotary collar or the like) in forward and reverse directions via the spring clutch. Accordingly, when rotation occurs in a direction to compress the spring clutch, the roller bracket 24 is lifted from the pressure-contact position to the lifted position. When rotation occurs in a direction to release the spring clutch, the roller bracket 24 is lowered from the lifted position to the pressure-contact position. In order to adjust the pressure-contact force in two steps being high and low, a pressurizing mechanism (pressurizing lever or the like) to pressurize the roller bracket 24 with a spring pressure may be added.

Next, configurations of the upper roller 21 and the lower roller 22 will be described with reference to FIG. 3B. As described above, the upper roller 21 is moved between the operating position Ap to be pressure-contacted to the lower roller 22 and the waiting position Wp to be apart therefrom. At the operating position Ap, the pressure-contact force is adjustable between the low pressurization state and the high pressurization state. The upper roller 21 is configured by combination of a large-diameter roller body 21*a* and a small-diameter roller body 21*b*. The large-diameter roller body and the small-diameter roller body are arranged in the sheet width direction in combination of one or more pairs thereof. In FIG. 3B, the large-diameter roller bodies 21*a* and the small-diameter roller bodies 21*b* are arranged as centering at the sheet center having the same distance therefrom. Here, the large-diameter roller body 21*a* is arranged outside the small-diameter roller body 21*b*.

The upper roller 21 is structured with the large-diameter roller bodies and the small-diameter roller bodies in a bilaterally symmetric manner against the sheet center. The large-diameter roller body 21*a* has an outer diameter being larger than that of the small-diameter roller body 21*b* by Δd and is structured with a soft member such as sponge and soft rubber. The small-diameter roller body 21*b* is smaller than the large-diameter roller body 21*a* by Δd and is structured with a hard member such as synthetic resin. Thus, the upper roller 21 is configured to have different outer diameters. In contrast, the lower roller 22 is structured with a relatively hard material having the same outer diameter.

Thus, the outer diameter difference (Δd) and the hardness difference between the large-diameter roller body 21*a* and the small-diameter roller body 21*b* are set so that the large-diameter roller body 21*a* is pressure-contacted to the lower roller 22 without being elastically deformed when being pressure-contacted to the lower roller 22 with the low pressurization force while the small-diameter roller body 21*b* is not pressure-contacted to the lower roller 22 as forming a space (gap) thereto (in the state of FIG. 4B). In contrast, when being pressure-contacted to the lower roller 22 with the high pressurization force, the large-diameter roller body 21*a* is elastically deformed and is pressure-contacted to the lower roller 22 along with the small-diameter roller body 21*b* (in the state of FIG. 4C).

When the large-diameter roller body 21*a* is pressure-contacted to the lower roller 22 without being elastically deformed as illustrated in FIG. 4B, contact area therebetween is small and a conveyance force to be applied by roller rotation is small. This is to suppress the following problem. In the case that a sheet is stacked on the lower roller 22, a sheet is fed through the path sheet discharging port 13*a* thereon, and the sheet is to be conveyed by the upper roller 21 in the direction opposite to the sheet discharging direction, the stacked sheet and the introduced sheet are frictionally slid to each other. At that time, a large roller pressure-contact force causes ink friction as image ink being in friction between the mutual sheets. In addition, a sheet face gets dirty with ink adherent to a roller surface or the like.

Further, in the illustrated apparatus, a roller pressure-contact angle is set so that a sheet is conveyed approximately at the same direction as a sheet placement face of the sheet placement base 16*s* as the sheet conveying direction being illustrated by an arrow in FIG. 4B in the state that the large-diameter roller body 21*a* is engaged with the lower roller 22 without being deformed. That is, the angle is set to be zero or to be close to zero. This is to reduce friction between the sheet introduced to the processing tray 16 and the stacked sheet. Such reduction of a frictional force between the mutual sheets is especially effective when images are formed at high speed by the image forming apparatus A at the upstream side or when characteristics of ink for image forming provides printing conditions under which ink friction is easily caused.

When the large-diameter roller body 21*a* is pressure-contacted to the lower roller 22 as being elastically deformed as illustrated in FIG. 4C, contact area therebetween is large and a conveyance force to be applied to sheets by roller rotation is large. Further, in the illustrated apparatus, conveyance is performed with the conveying direction being upwardly shifted from the sheet placement face of the sheet placement base 16*s* by an angle θa in FIG. 4C.

Thus, by structuring the upper roller 21 with the large-diameter roller body 21*a* and the small-diameter roller body 21*b* and varying the pressurization force to be applied to the respective rollers in two steps being high and low, the sheet fed to the path sheet discharging port 13*a* can be conveyed while varying the conveying mechanism as illustrated in FIGS. 4B and 4C in accordance with a conveyance mode. That is, when the sheet fed to the path sheet discharging port 13*a* is introduced to the processing tray 16 with switch-back conveying, ink friction between the mutual sheets can be prevented. When the sheet is conveyed from the path sheet discharging port 13*a* to the stack tray 40, the sheet is conveyed toward the tray with the sheet discharging direction being set in a parabola direction in an upward posture, so that the sheet on the tray can be discharged relatively further.

The reason why the reversing roller 20 is structured with the pair of large-diameter and small-diameter rollers is as follows. The reversing roller 20 discharges a sheet fed to the path sheet discharging port 13*a* selectively to the stack tray 40 and the processing tray 16 in a first sheet discharge mode and a second sheet discharge mode which are described later. In the first sheet discharge mode, the sheet fed to the path sheet discharging port 13*a* is conveyed to the stack tray 40 at the downstream side by nipping one by one with the upper roller 21 and the lower roller 22.

Accordingly, in the first sheet discharge mode, since sheets are nipped between the upper roller 21 and the lower roller 22 one by one, reliable conveyance can be performed to the downstream side owing to roller rotation without occurrence of slippage between the rollers and a sheet. In the second sheet discharge mode, the sheet fed from the path sheet discharging port 13*a* is introduced onto the uppermost sheet which is previously stacked, and then, the sheet is conveyed, as sliding on the uppermost sheet, in the sheet discharging direction and subsequently in the opposite direction to the sheet discharging direction as being pressed by the upper roller 21.

As described above, regarding the different conveyance modes, according to the nip conveyance in the first sheet discharge mode, a sheet (sheet bundle in a later-mentioned bundle discharge mode) can be discharged and accommodated reliably in the stack tray 40 at the downstream side with a strong pressure-contact force. In the second sheet discharge mode, slippage between mutual sheets is unavoidable. In this case, since there is a fear that ink friction occurs with an image formed on a sheet face, it is preferable that a sheet is conveyed with a weak pressure-contact force.

Further, for example, from a viewpoint of compatibility (adhesiveness) with image forming ink, there is a case that a roller surface is coated. Regarding the illustrated rollers, a surface-hardening process such as ceramic coating and a fluorine coating is performed on each surface of the small-diameter roller body 21*b* and the lower roller 22 which conveys a sheet with nipping. According to the above, there is not a fear that a subsequent sheet gets dirty with ink friction as being adhesive to a roller surface even when ink on the sheet is insufficiently fixed.

Further, in the later-mentioned second sheet discharge mode, a sheet fed from the path sheet discharging port 13*a* is stacked on the sheet placement base 16*s* in a lamination manner, and then, a sheet fed from the path sheet discharging port 13*a* is conveyed in a switch-back manner by the upper roller 21, on the uppermost sheet, in the sheet discharging direction and subsequently in the opposite direction to the sheet discharging direction. The upper roller 21 is required to perform conveyance to a predetermined post-processing position while preventing strong friction between the sheet stacked on the sheet placement base 16*s* and the sheet introduced from the path sheet discharging port 13*a*.

Here, there is a fear that image ink friction occurs when friction occurs between mutual sheets as well as a problem that an ink layer adherent to a roller surface adheres to a sheet face. In order to solve image shifting and dirty marks between sheets, the upper roller 21 is structured with a large-diameter roller being a soft roller made of sponge or the like. In addition, a roller pressure-contact angle is set so that a roller contact point is moved in a direction where a sheet follows along the face of the sheet placement base 16*s*.

Further, regarding the sheet introduced to the processing tray 16, only the large-diameter roller body 21*a* is pressure-contacted to the sheet face and a gap is formed against the small-diameter roller body 21*b* without being pressure-contacted thereto. Accordingly, contact area between the roller and the sheet is small and the pressurization force is set at the low pressurization force. Therefore, static electricity occurring between mutual sheet (between a stacked sheet and an introduced sheet) is slight, so that conveyance of a subsequent sheet is not disturbed by accumulated static electricity.

In the above, description is performed on the configuration that a sheet bundle is conveyed to the stack tray 40 at the downstream side by the reversing roller mechanism 20 after a binding process is performed on the sheet bundle stacked on the processing tray 16. However, it is also possible to arrange conveyer means which discharges a sheet bundle from the processing tray 16 along with the reversing roller mechanism 20.

As illustrated in FIG. 2, the regulating stopper 18 is structured with a plate-shaped member which performs regulation with abutting against a sheet tailing end and is arranged at one position or a plurality of positions as being distanced in the sheet width direction. The regulating stopper 18 is arranged at a sheet tailing end edge along with the post-processing means 17 such as a staple unit. Accordingly, when the staple unit 17 is arranged movably in the sheet width direction, the regulating stopper 18 is configured to be movable as well in the sheet width direction as being interlocked with the staple unit 17. In contrast, when the staple unit 17 is fixedly arranged without being moved in the sheet width direction, it is also possible to arrange the regulating stopper 18 integrally with the staple unit 17.

[Stack Tray]

Figure 5:
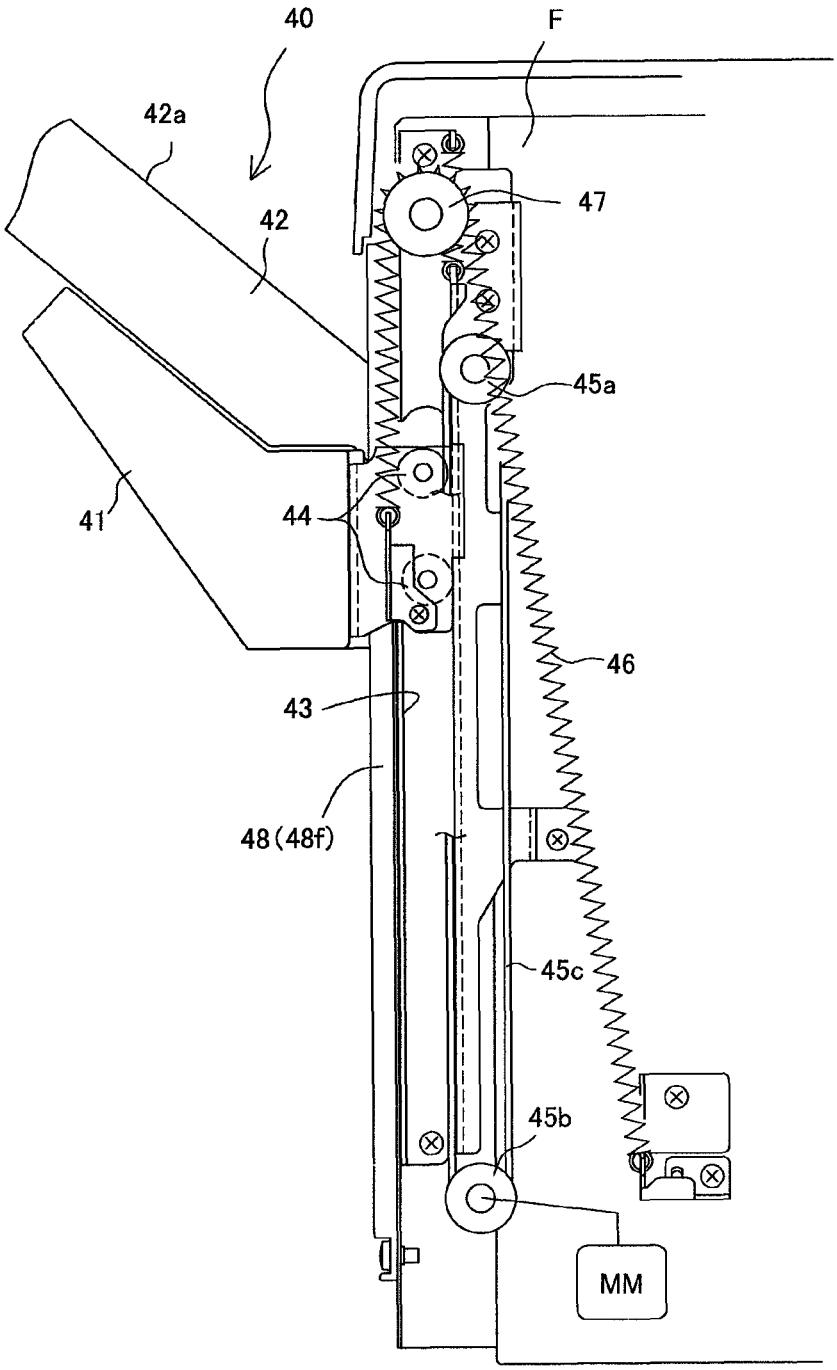
FIG. 5 is an explanatory view of a configuration of a lifting-lowering mechanism of the stack tray illustrated in FIG. 2.

Next, the stack tray 40 will be described. As illustrated in FIGS. 2 and 5, the stack tray 40 is arranged at the downstream side of the path sheet discharging port 13*a* of the sheet discharging path 11. The abovementioned processing tray 16 is arranged at the downstream side of the path sheet discharging port 13*a*. The stack tray 40 is arranged at the downstream side of the path sheet discharging port 13*a* and the tray sheet discharging port 13*b* of the processing tray 16. Here, a single sheet is discharged through the path sheet discharging port 13*a* and a single sheet or a sheet bundle are discharged through the tray sheet discharging port 13*b*, so as to be stored at the stack tray 40 in both cases.

The stack tray 40 is structured with a tray base 41 and a sheet placement tray 42. The tray base 41 is supported by the apparatus frame F to perform lifting-lowering motion at a predetermined stroke. The sheet placement tray 42 is configured to be a tray shape having a tray face on which sheets are stacked and stored. The sheet placement tray 42 is supported by the tray base 41. Here, a jog shifting mechanism (not illustrated) is arranged so that the sheet placement tray 42 performs jog shifting by a predetermined amount in the sheet width direction against the tray base 41.

[Tray Lifting-lowering Mechanism]

FIG. 5 illustrates a lifting-lowering mechanism of the stack tray 40. A guide rail 43 (see FIG. 5) is arranged at the apparatus frame F vertically in the stacking direction. Slide rollers 44 fixed to a joint portion (joint plate) of the tray base 41 are fitted to the guide rail 43. The guide rail 43 is structured with bar-shaped guide, channel steal, H-shaped steel, or the like and the tray base 41 is slidably fitted thereto.

The tray base 41 is configured with a frame structure having strength for supporting loads of the sheet placement tray 42 and sheets stacked thereon and is cantilever-supported by the guide rail which is similarly stiff. Further, a suspension pulley 45*a* and a winding pulley 45*b* are axially fixed to the apparatus frame F respectively at an upper end part and a lower end part of the guide rail 43. A tow member 45*c* such as a wire and a geared belt is routed between both the pulleys. A winding motor MM is connected to the winding pulley 45*b* via a deceleration mechanism.

Further, a coil spring 46 for weight lightening is routed between the tray base 41 and the apparatus frame F. That is, one end (lower end in FIG. 5) of the coil spring 46 is fixed to the apparatus frame F and the other end (upper end in FIG. 5) is fixed to the tray base 41 via a tow pulley 47. Initial tension is applied to the coil spring 46. Accordingly, the sheet placement tray 42 and sheets stacked thereon are lightened in weight in accordance with an elastic force of the coil spring 46 and load torque of the winding motor MM is reduced. Further, it is also possible to adopt a weight lightening mechanism which hangs a weight from a hanging pulley instead of a coil spring.

[Sheet Placement Tray]

The sheet placement tray 42 includes a sheet placement face 42*a* on which sheets fed from the path sheet discharging port 13*a* at the upper side are placed in a lamination manner. The sheet placement face 42*a* may be horizontally arranged. Here, the sheet placement face 42*a* is inclined by a predetermined angle. This is for correcting the stacked sheets in posture to the tailing end side owing to own weight. It is preferable that the inclination angle of the sheet placement face 42*a* is approximately in a range between 30° and 45° against a horizontal surface. When the inclination angle is 30° or less, it is difficult to perform sheet correction in posture. When the inclination angle is 45° or more, there is a fear that a curled sheet is overturned at the time of entering the sheet placement tray 42. The sheet placement tray 42 is supported by the tray base 41 and performs lifting and lowering motion along the guide rail 43. Further, a fence plate 48 having a tailing end regulating face 48*f* which regulates a sheet tailing end is arranged at the apparatus frame F.

In order to solve following problems which arise when a sheet is conveyed from the abovementioned sheet discharging path 11 selectively to the processing tray 16 and the stack tray 40, the present invention has a feature of including corrugation forming means 50 which deforms a sheet into a corrugated-plate shape (hereinafter, called reinforcement) and de-curling means 60 which corrects a curl of a reinforced sheet to be flat.

(Problems in Sheet Conveyance with an Apparatus without Corrugation Forming Means 50 and De-Curling Means 60)

In a case that a vertical interval (step dh1) is formed between the sheet discharging path 11 and the processing tray 16, a triangular space is formed among the path sheet discharging port (first sheet discharging port) 13*a*, the tray sheet discharging port (second sheet discharging port) 13*b*, and the friction rotor 19 on the processing tray 16. A sheet leading end jumps in the air from the path sheet discharging port 13*a* toward the reversing roller 20 which is arranged between the path sheet discharging port 13*a* and the tray sheet discharging port 13*b*.

Here, when a distance L1 between the first and second sheet discharging ports 13*a*, 13*b* is long, a curled sheet and a soft sheet such as a thin sheet cause sheet jamming. For example, a sheet curled to the lower side (downward) is caught onto the processing tray 16 without a leading end thereof arriving at the reversing roller 20. Accordingly, it is required to adopt a conveying mechanism with which a sheet leading end reliably arrives at the second sheet discharging port 13*b* from the first sheet discharging port 13*a* without jamming when being conveyed as jumping. Further, a sheet discharged from the first sheet discharging port 13*a* has the conveying direction reversed by the reversing roller 20 and is conveyed with the tailing end in the lead toward the regulating stopper 18 on the processing tray 16. At that time, there may be a case that the sheet does not reliably arrive at the regulating stopper 18 when the sheet is curled or soft as being a thin sheet.

Further, a sheet discharged from the tray sheet discharging port (second sheet discharging port) 13*b* to the stack tray 40 is stored on the sheet placement face 42*a* of the sheet placement tray 42 which is provided with a vertical interval dh2. In a case that the sheet placement face 42*a* is inclined to be higher toward the front side in the sheet discharging direction, the sheet slides on the uppermost sheet on the sheet placement face 42*a* while being recurvate to the upper side. When the sheet is reinforced at that time, there may be a case that the uppermost sheet is shifted to the outside of the stack tray 40 and is disturbed in posture owing to movement of the sheet introduced from the tray sheet discharging port 13*b*.

In order to solve such problems, it is required to arrange reinforcing means so that a sheet is reliably conveyed to the downstream side until being conveyed to the tray sheet discharging port 13*b* from the path sheet discharging port 13*a*. Further, when sheet discharging is performed while a sheet leading end slides on the uppermost sheet on the stack tray 40, it is required that the sheet is conveyed as being easily deformed along the inclined sheet placement face 42*a* without being reinforced.

According to the present invention, a sheet is reinforced by the corrugation forming means 50 arranged at the sheet discharging path 11 to reliably convey the sheet leading end to the reversing roller 20 located at the downstream side when the sheet is conveyed by the sheet discharging roller 15 to the reversing roller 20 located at the downstream side, and then, switch-back conveying is performed as the sheet tailing end being conveyed to the regulating stopper 18. Further, the de-curling means 60 is provided to correct a sheet to be flat when the sheet reinforced by the corrugation forming means 50 is introduced to the stack tray 40. The corrugation forming means 50 and the de-curling means 60 will be described in the following.

[Corrugation Forming Means]

Figure 6A:
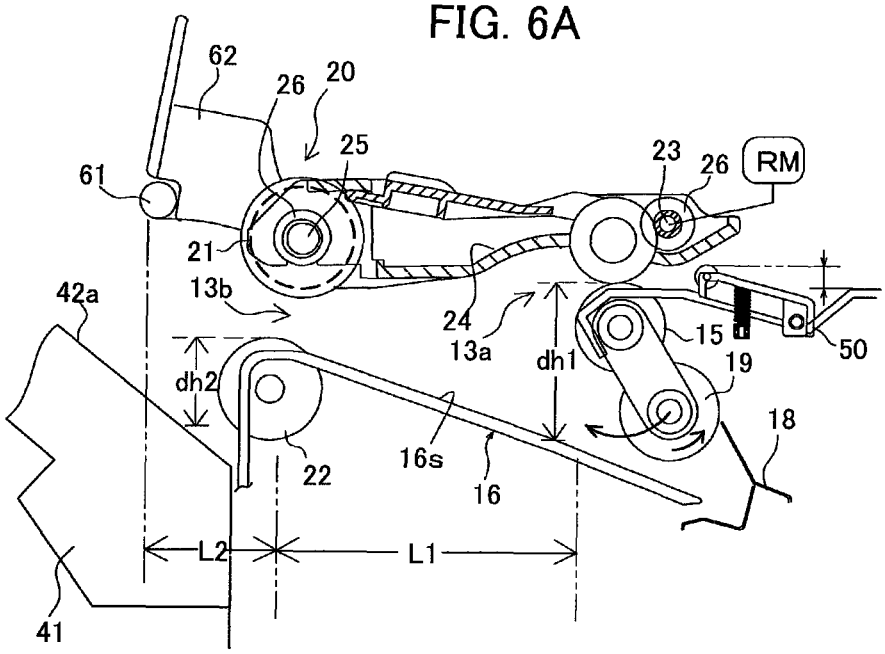

FIG. 6A is an explanatory view illustrating a whole configuration of the abovementioned sheet discharging mechanism as enlarging a main part of FIG. 2. FIG. 6A illustrates the sheet discharging roller 15 which is arranged at the sheet discharging path 11, and the reversing roller 20 which is arranged between the path sheet discharging port 13*a* and the tray sheet discharging port 13*b*. The sheet discharging roller 15 and the reversing roller 20 are structured with a plurality of rollers which are mutually distanced in the direction perpendicular to the sheet discharging direction, respectively. Each roller is structured with a roller pair mutually pressure-contacted. Details thereof will be described later. The corrugation forming means 50 to curve and deform a sheet into a corrugated-plate shape is arranged between the sheet discharging rollers 15. According to the above, a sheet nipped in the same plane is deformed into a ridge shape (corrugated-plate shape) between the nipping points, so that the sheet is reinforced.

Figure 6B:
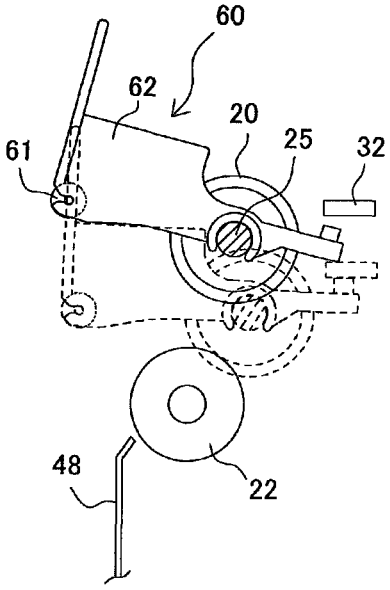
Figure 6C:
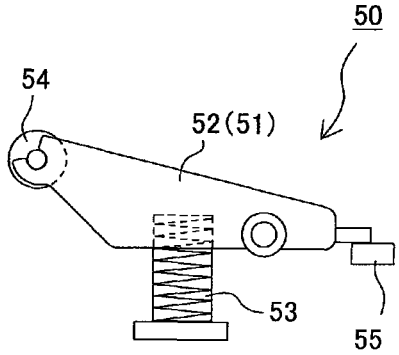

As illustrated in FIG. 6C, the corrugation forming means 50 is structured with a guide rib 51 protruded upward from a paper guide which forms the sheet discharging path 11. The guide rib 51 may be formed integrally with the paper guide. In FIG. 6C, a guide lever 52 is rotatably axis-supported by the paper guide (frame member) and an urging spring 53 continuously urges a sheet to push to the upper side of the sheet discharging path 11. Further, an idling roller 54 which is engaged with a sheet lower face is rotatably supported at a top end of the guide lever 52.

As described later, the corrugation forming means 50 are arranged respectively at five positions between the sheet discharging rollers 15. Accordingly, the sheet discharged by the sheet discharging roller 15 to the first sheet discharging port 13*a* is formed with corrugations having a ridge shape (corrugated-plate shape) at five positions aligned in the sheet width direction.

As illustrated in FIG. 6C, the guide rib 51 is swingably axis-supported at the base end portion thereof by the paper guide. The urging spring 53 pushes a sheet lower face, so that the sheet is curved and deformed. Further, a position regulating stopper 55 is provided. The idling roller 54 which reduces friction against the sheet lower face is axis supported at the top end of the guide rib 51.

In the above description, the guide rib 51 is arranged at a path guide at the upstream side of the sheet discharging roller 15 of the sheet discharging path 11. However, it is also possible to arrange the guide rib 51 at the downstream side of the sheet discharging roller 15. In this case, a member (e.g., rib member) which forms a corrugation on a sheet is arranged between the path sheet discharging port 13*a* and the tray sheet discharging port 13*b*, so that a corrugation is formed by a rib which is engaged with a lower face of a sheet proceeding from the path sheet discharging port 13*a* to the tray sheet discharging port 13*b*. Naturally, not being like the illustrated embodiment, a rib may be formed integrally with the path guide without arranging the idling roller 54 at the guide rib 51.

Figure 7:
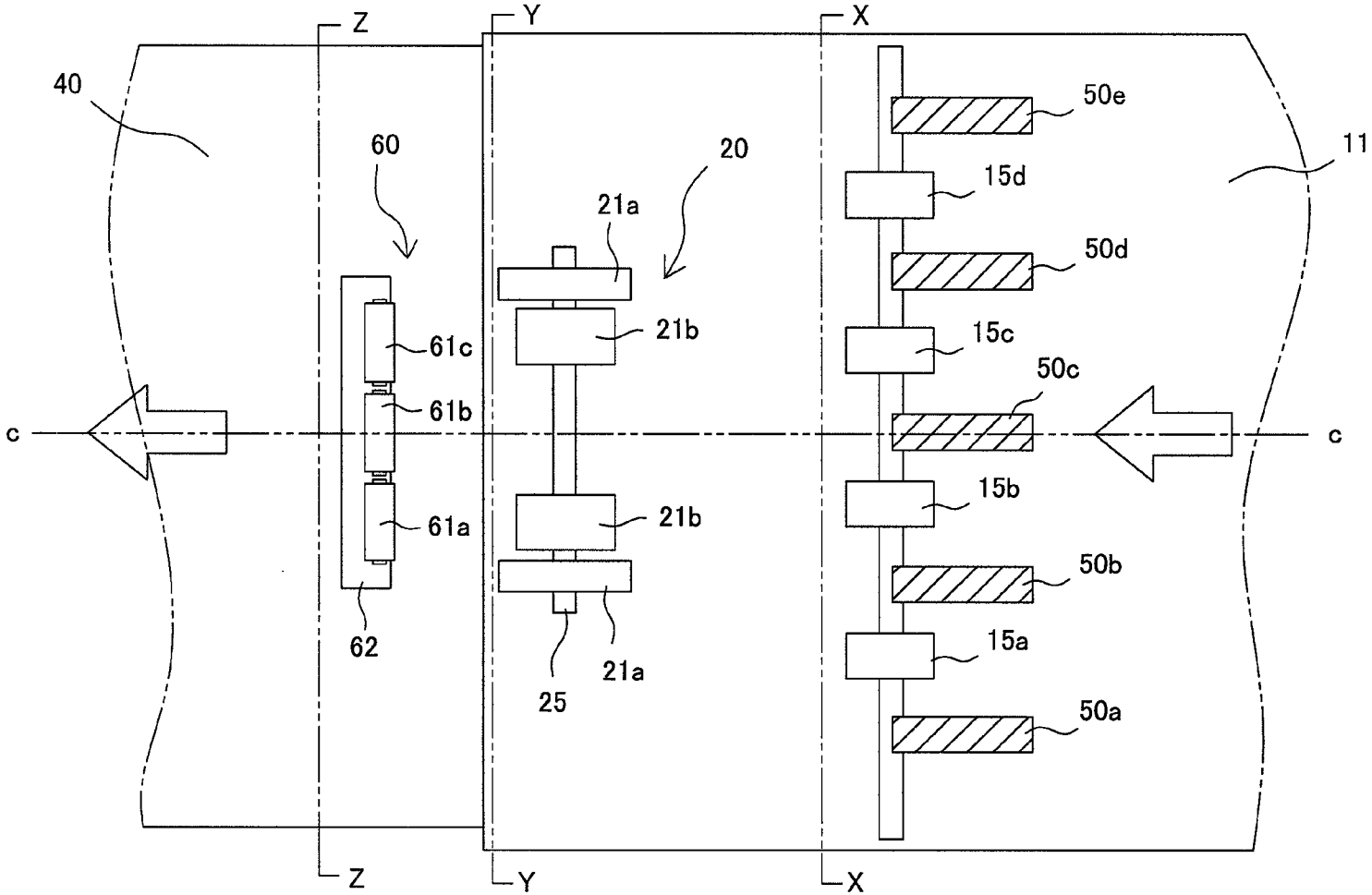
FIG. 7 is an explanatory view illustrating a plane configuration of the corrugation forming means and the de-curling means.

FIG. 7 is an explanatory view illustrating a positional relation between the sheet discharging roller 15 and the guide rib 51. The sheet discharging roller 15 is structured with a plurality of rollers which are distanced in accordance with a width size of a maximum sheet and an uppermost sheet to be conveyed according to center reference (c-c reference). FIG. 7 illustrates four aligned rollers 15 (15*a*, 15*b*, 15*c*, 15*d*). Each roller is structured with an upper roller and a lower roller which are mutually pressure-contacted.

Guide ribs (50*a*, 50*b*, 50*c*, 50*d*, 50*e*) are arranged respectively between the sheet discharging rollers 15, so that ridge-shaped (corrugated-plate-shaped) corrugations are formed at positions indicated by solid arrows in FIG. 7. The reversing roller 20 (the upper roller 21 and the lower roller 22) is arranged at the downstream side of the sheet discharging roller 15 as having a distance therebetween. In FIG. 7, the reversing roller 20 is structured with a right-left pair of rollers (a right roller R and a left roller L) mutually distanced in the sheet width direction (the direction perpendicular to the sheet discharging direction), each being structured with a pair of upper and lower rollers mutually pressure-contacted. The right and left reversing rollers 20 (20R, 20L) are arranged so that a corrugation (Co3 in FIG. 8A) at the center formed by the sheet discharging roller 15 at the upstream side is located therebetween. Further, the de-curling means 60 is arranged at the downstream side of the reversing roller 20.

Figure 8A:
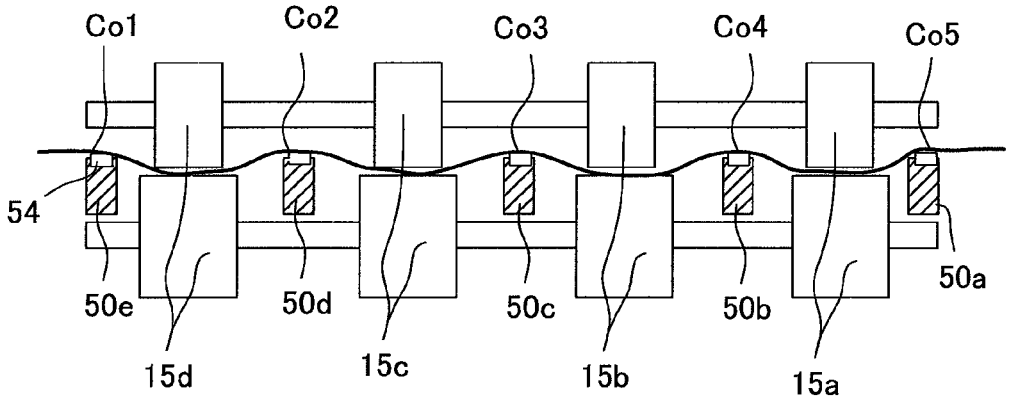
Figure 8B:
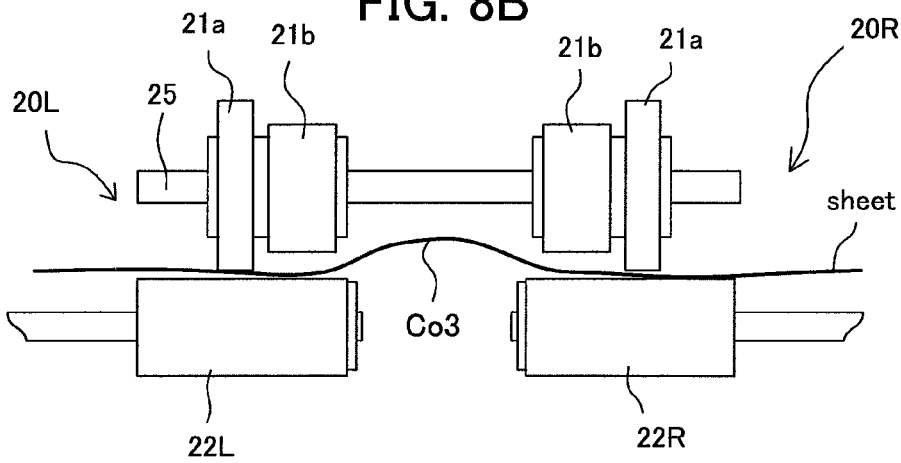
Figure 8C:
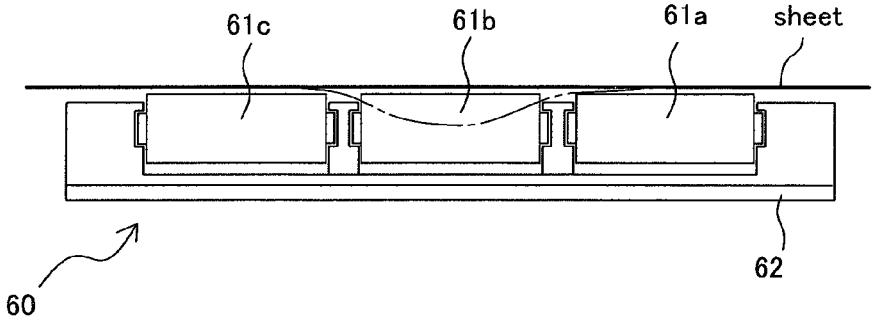

FIGS. 8A to 8C are explanatory views illustrating corrugation states of a sheet proceeding from the sheet discharging path 11 to the stack tray 40. FIG. 8A illustrates a state in which corrugations are formed on a sheet by the corrugation forming means 50 and the sheet discharging roller 15. FIG. 8B illustrates a corrugation state of a sheet which is nipped by the reversing roller 20. FIG. 8C illustrates a state in which a sheet is corrected to be flat by the later-mentioned de-curling means 60 at the downstream side of the reversing roller 20.

In the state illustrated in FIG. 8A, five strips of corrugations (Co1, Co2, Co3, Co4, Co5 in FIG. 8A) are formed on a sheet. In the state illustrated in FIG. 8B, one strip of corrugation Co3 is maintained in shape on the sheet and the rest of corrugations Co1, Co2, Co4, Co5 are naturally vanished. Thus, a plurality (five in FIG. 8A) of corrugations are formed on the sheet until the sheet leading end arrives at the reversing roller 20 from the first sheet discharging port 13*a*, so that jumping conveyance can be reliably performed owing to reinforcement thereby. In the state illustrated in FIG. 8C, one strip of corrugation formed on the sheet discharging through the tray sheet discharging port 13*b* is corrected to be flat by the later-mentioned de-curling means 60.

[De-Curling Means]

The de-curling means 60 illustrated in FIG. 6B will be described. The de-curling means 60 is arranged between the tray sheet discharging port 13*b* and the sheet placement face 42*a* of the stack tray 40 and is engaged with an upper face of a sheet, in the sheet discharging direction, discharged by the reversing roller 20 to correct the corrugation-formed sheet into a flat shape. Accordingly, the de-curling means 60 is structured with a guide member (hereinafter, called a de-curl guide) which has an engagement face to be engaged with a sheet front face. The de-curl guide 60 is structured with guide rollers 61 (61*a*, 61*b*, 61*c*) which is engaged with a sheet front face, and a guide holder 62 which supports the guide rollers 61. The guide holder 62 is structured as being axis-supported by the rotary shaft 25 of the upper reversing roller 20 and lifted and lowered integrally with the reversing roller 20 which performs lifting and lowering. According to the above, when sheet jamming occurs at the tray sheet discharging port 13*b*, the reversing roller 20 and the de-curling guide 60 located at the downstream side thereof can be integrally retracted upward from the sheet path. A stopper member 32 positionally regulates the de-curling means 60.

Figure 9A:
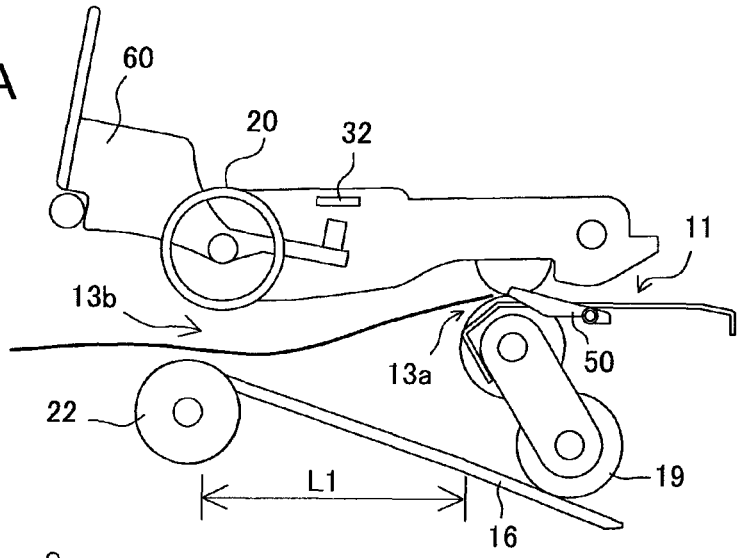

Next, operations of the corrugation forming means 50 and the de-curling means 60 will be described with reference to FIGS. 9A to 9C. FIG. 9A illustrates a state in which a sheet is conveyed from the sheet discharging path 11 sequentially to the path sheet discharging port 13*a*, the reversing roller 20, and the tray sheet discharging port 13*b*. At that time, the reversing roller 20 is located at the waiting position (in a state that the upper roller and the lower roller are apart from each other) and a conveyance force is applied to the sheet owing to rotation of the sheet discharging roller 15 in the sheet discharging direction.

Then, a plurality of corrugated-plate-shaped corrugations are formed on the sheet discharged through the path sheet discharging port 13*a* by the corrugation forming means 50. Accordingly, the sheet is reinforced and jumping conveyance can be performed over a section L1 approximately in a linear direction even with a sheet curled upward or downward or a thin sheet.

Figure 9B:
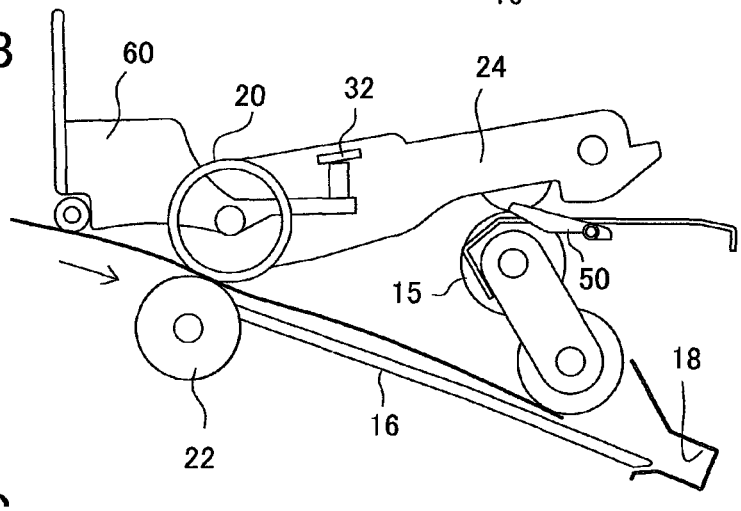

FIG. 9B illustrates a state in which the sheet conveyed from the sheet discharging path 11 is introduced and positioned onto the processing tray 16. The sheet with the leading end thereof conveyed to the second sheet discharging port 13*b* drops onto the processing tray 16 when the tailing end thereof passes through the first sheet discharging port 13*a*. At that timing, controlling means (not illustrated) lowers the upper roller 21 from the waiting position Wp (in the state of FIG. 9A) to the operating position Ap (in the state of FIG. 9B), so that the sheet leading end is nipped between the upper roller 21 and the lower roller 22. Subsequently, when the upper roller 21 is reversely rotated in the direction opposite to the sheet discharging direction, the sheet is reversely conveyed with the tailing end thereof following along the sheet placement base 16*s* of the processing tray 16.

Figure 10:
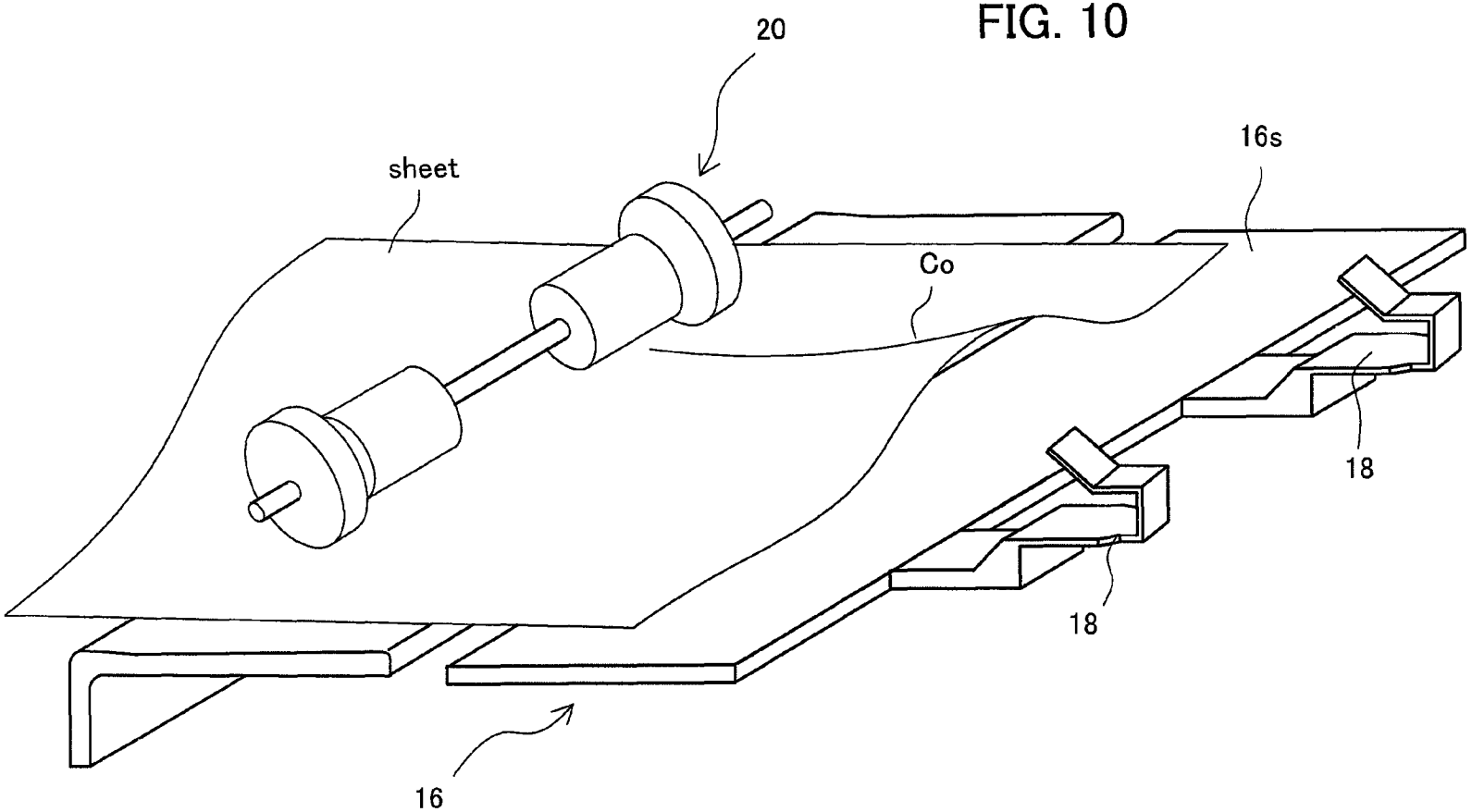
FIG. 10 is an explanatory view of the state of positioning while the sheet is reinforced and abutted to the regulating stopper.

At that time, since a plurality of corrugations are formed at the sheet tailing end in the width direction (the direction perpendicular to the sheet discharging direction), the sheet tailing end arrives at the regulating stopper 18 as being forced in a linear direction even with a tailing-end-curled sheet or a thin sheet. FIG. 10 illustrates a state in which the sheet tailing end is to be abutted to the regulating stopper 18. Here, a configuration to guide a sheet to the regulating stopper 18 by the friction rotor 19 is not illustrated in FIG. 10. Since the corrugation Co is formed at the center of the sheet, the sheet is abutted to the regulating stopper 18 without being recurvate to the upper side and to the lower side.

Figure 9C:
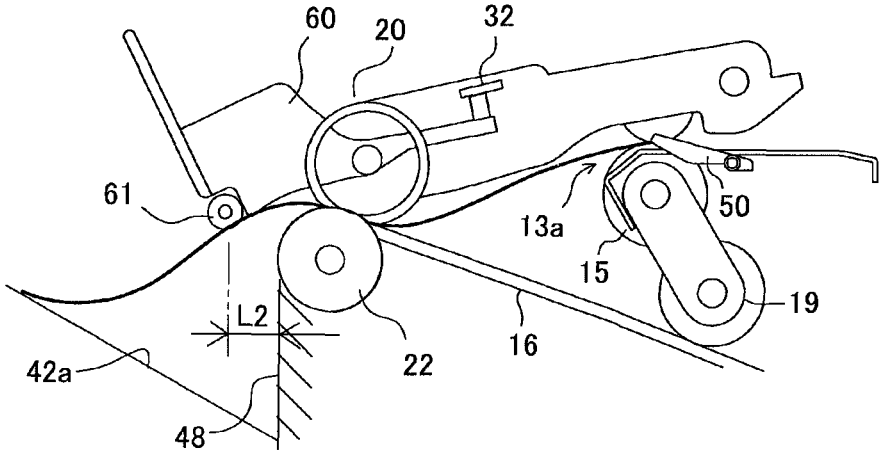

FIG. 9C illustrates a case in which the sheet conveyed from the first sheet discharging port 13*a* to the second sheet discharging port 13*b* is discharged to the stack tray 40 without being conveyed to the processing tray 16. Similarly to the abovementioned case, the sheet conveyed from the sheet discharging path 11 has plural strips of corrugations aligned in the sheet width direction and is conveyed by the reversing roller 20 in the sheet discharging direction. That is, the controlling means (not illustrated) moves the upper roller 21 from the waiting position Wp (in the state of FIG. 9A) to the operating position Ap (in the state of FIG. 9C) in a case that the sheet is discharged to the stack tray 40 without being conveyed to the processing tray 16. Then, the sheet is nipped between the upper and lower rollers and is discharged toward the stack tray 40 at the downstream side owing to rotation of the reversing roller 20 in the sheet discharging direction (clockwise direction).

At that time, the de-curling guide 60 is arranged at an opposed position to be faced to the reversing roller 20 as having a distance L2 against the nipping point thereof. Accordingly, the sheet is corrected to be flat by an engagement face (the guide roller 61 in FIG. 9C). Here, the guide roller 61 has a width to cover a space in the sheet width direction between rollers of the reversing roller 20. According to the above, a contact face with the sheet can be enlarged, so that the corrugation can be corrected to be flat regardless of a position or a size of the corrugation.

Further, when the guide roller 61 is arranged at a position having approximately equal width as the maximum width of an engagement portion of the reversing roller 20 as being faced thereto in addition to the space between the rollers of the reversing roller 20, the corrugation can be corrected more stably. Further, owing to that a contact face between the sheet and the de-curling means 60 is enlarged as described above, the corrugation can be corrected without increasing contact pressure therebetween compared to a case of point contact. Accordingly, it is possible to suppress occurrence of friction between sheets, dirty marks, and the like.

Figure 11:
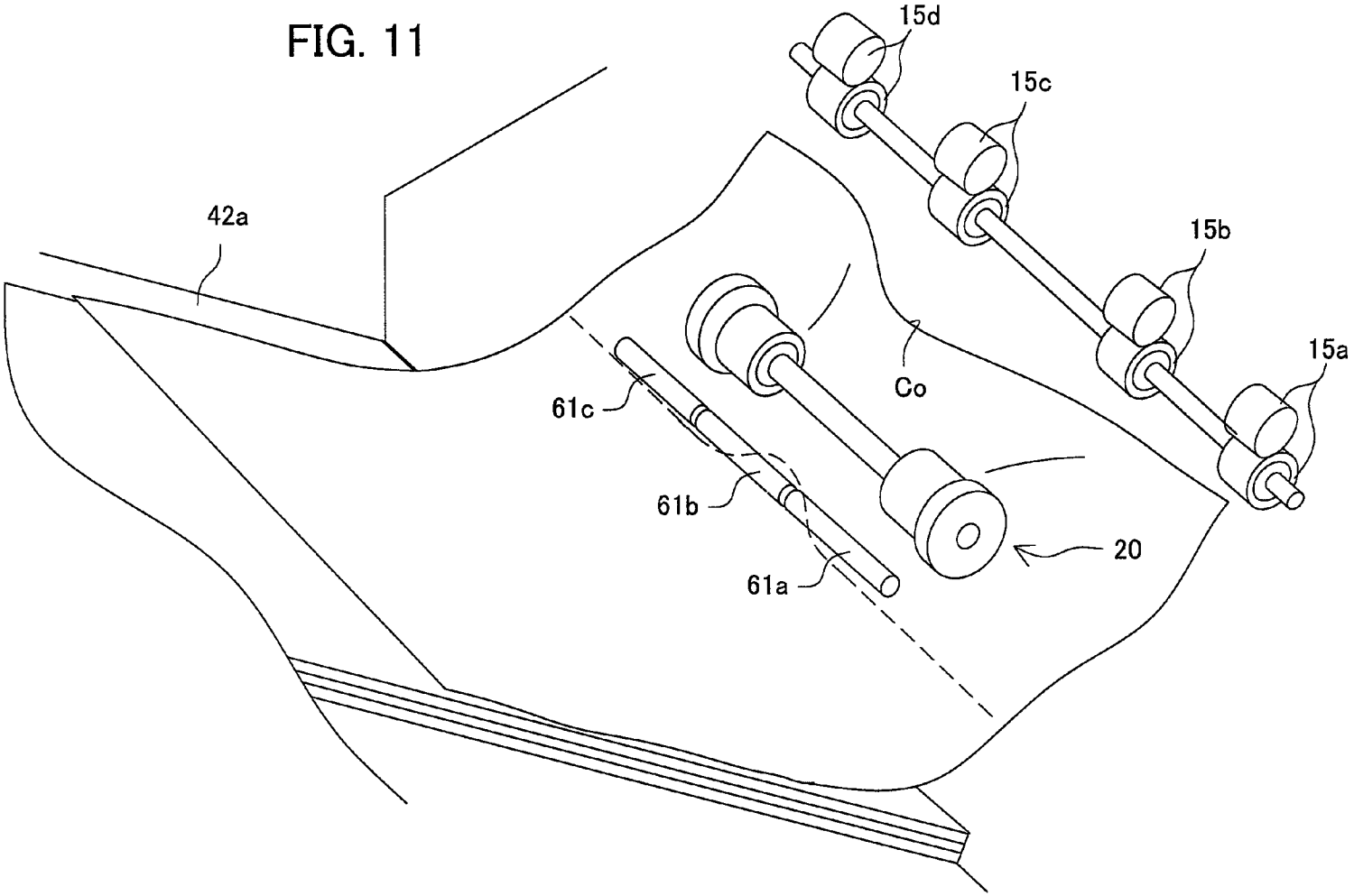
FIG. 11 is an explanatory view of the state of FIG. 9C in which the sheet is de-curled and stored at the stack tray.

FIG. 11 illustrates a sheet discharging state due to the de-curling guide 60 (see FIG. 8C). The sheet discharged through the tray sheet discharging port 13*b* having the corrugation Co at the sheet center thereof is corrected to have a flat sheet face by the guide roller 61 which is located at the front side in the sheet discharging direction. Then, the sheet leading end is gradually conveyed in the sheet discharging direction along sheets stacked on the sheet placement face 42*a* of the stack tray 40. When the sheet tailing end exceeds a nipping point of the reversing roller 20, the sheet is stored on the sheet placement face 42*a* owing to own weight of the de-curling guide 60. Then, the sheet tailing end is positioned to a regulating face (not illustrated). At that time, the de-curling guide 60 is located at a position being apart by the distance L2 from the nipping point of the reversing roller 20. Accordingly, the sheet is stored at the stack tray 40 at the lower side without being stuck with a circumferential face of the reversing roller 20 owing to own weight of the de-curling guide 60.

[Description of Sheet Discharge Mode]

Next, description will be performed on a sheet discharge mode of the present invention in which a sheet is conveyed from the sheet discharging path 11 to the processing tray 16 and the stack tray 40. The illustrated apparatus is provided with the first sheet discharge mode (print-out mode) and the second sheet discharge mode (post-processing mode). In the first sheet discharge mode, a sheet conveyed to the sheet discharging path 11 is conveyed to the tray sheet discharging port 13*b* which is distanced from the path sheet discharging port 13*a*, and then, the sheet is conveyed to the stack tray 40 without being guided to the processing tray 16. In the second sheet discharge mode, the sheet is guided from the path sheet discharging port 13*a* to the processing tray 16.

In the first sheet discharge mode, an image-formed sheet is guided to the sheet discharging path 11. Then, the sheet is reinforced by forming a plurality of corrugations thereon while being conveyed on the sheet discharging path 11. Subsequently, the reinforced sheet is conveyed from the path sheet discharging port 13*a* to the reversing roller 20 which is located at the downstream side as being distanced therefrom. At that time, the reversing roller 20 is positionally controlled at the operation position where the upper and lower rollers 21, 22 are mutually pressure-contacted or the waiting position where the upper and lower rollers 21, 22 are apart from each other.

Then, as described above, the sheet is conveyed with jumping of the leading end thereof from the first sheet discharging port 13*a* to the second sheet discharging port 13*b* owing to influence of corrugations. The corrugations are corrected by the de-curling means 60 while the sheet proceeds from the reversing roller 20 to the sheet placement face 42*a* of the stack tray 40 and the sheet is placed on the uppermost sheet on the sheet placement face 42*a* in a flat shape. According to the above, the sheet is smoothly stored along a face of a sheet stacked on the sheet placement face 42*a* without causing positional shifting to push out the stacked sheet.

Here, in the first sheet discharge mode, the reversing roller 20 conveys a sheet in a state that the small-diameter roller body 21*b* of the upper roller 21 is pressure-contacted to the lower roller 22 as being pressurized with the high pressurization force. In this case, since the sheet is pressure-contacted from front and back faces by the lower roller 22 and the upper roller 21, image friction is less caused and sheet conveyance is reliably performed.

In the second sheet discharge mode, the sheet conveyed to the sheet discharging path 11 is conveyed from the path sheet discharging port 13*a* onto the processing tray 16, and then, the sheet is stored at the stack tray 40 at the downstream side after a post-process is performed on the processing tray 16. In the second sheet discharge mode, the reversing roller 20 is moved from the waiting position Wp to the operating position Ap after the sheet leading end passes through the nipping point based on a signal of the sheet leading end detected by the discharge sensor Se2, and then, the reversing roller 20 is reversely rotated in the direction opposite to the sheet discharging direction after the sheet tailing end passes through the path sheet discharging port 13*a*.

Accordingly, the conveying direction of the sheet is reversed in a state that the leading end thereof is at the downstream side of the reversing roller 20 and the tailing end thereof is dropped from the path sheet discharging port 13*a* onto the processing tray 16. The sheet is abutted to and regulated by the regulating stopper 18 owing to rotation of the friction rotor 19. A post-process (staple binding process in the drawings) is performed by the post-processing means 17 in a state that predetermined number of sheets are stacked on the processing tray 16, and then, the sheet bundle is conveyed to the stack tray 40 by the reversing roller 20.

In the second sheet discharge mode, the reversing roller 20 conveys a sheet in a state that the large-diameter roller body 21*a* is pressure-contacted to the lower roller 22 as being pressurized with the low pressurization force. In this case, a sheet is stacked on the processing tray 16 and a sheet is introduced thereon. Therefore, the pressurization force is reduced to prevent occurrence of image friction to be caused by mutual friction between the sheet lower face and an upper face of the stacked sheet.

In either sheet discharge mode, height control to adjust a tray height position by detecting a sheet face level of the uppermost sheet stacked on the sheet placement face 42*a* is adopted for the stack tray 40 as a control method which is previously known.

What is claimed is:

1. A sheet storing apparatus in which a sheet is discharged to a processing tray and a stack tray from either of a first sheet discharging port and a second sheet discharging port which are arranged as being distanced in a conveying direction, comprising:

a sheet discharging path which guides a sheet conveyed to an introducing port toward the first sheet discharging port;

the processing tray which is arranged at the downstream side as forming a step against the first sheet discharging port;

the second sheet discharging port which is arranged above the processing tray at a position being distanced from the first sheet discharging port;

the stack tray which is arranged at the downstream side of the second sheet discharging port;

a first conveying roller which discharges a sheet to the first sheet discharging port as being arranged on the sheet discharging path;

a second conveying roller which is capable of being rotated forwardly and reversely to convey a sheet selectively to the processing tray and the stack tray as being arranged between the first sheet discharging port and the second sheet discharging port;

corrugation forming means which forms a plurality of corrugations aligned in the direction perpendicular to the conveying direction on a sheet proceeding from the first conveying roller to the second conveying roller; and de-curling means which is arranged between the second conveying roller and a sheet placement face of the stack tray to correct the corrugation formed on a sheet to be flat, so that the number of corrugations of a sheet proceeding from the second conveying roller to the stack tray is smaller than the number of corrugations of a sheet proceeding from the first conveying roller to the second conveying roller, wherein the first and second conveying rollers are structured respectively with a plurality of roller pairs which are aligned at a predetermined interval in the direction perpendicular to the conveying direction, and a section having an engagement width in the direction perpendicular to the conveying direction between a sheet and the plurality of second conveying rollers located at the downstream side is narrower than a section having an engagement width in the direction perpendicular to the conveying direction between a sheet and the plurality of first conveying rollers.

2. The sheet storing apparatus according to claim 1, wherein the corrugation forming means is structured with a projection-shaped guide arranged between rollers of the first conveying roller, and the projection-shaped guide is arranged at least at either of the upstream side or the downstream side of the first conveying roller.

3. The sheet storing apparatus according to claim 1, wherein the first conveying roller is structured with a plurality of roller pairs as being mutually distanced in the direction perpendicular to the conveying direction, the second conveying roller is structured with two roller pairs as having a distance there between in the direction perpendicular to the conveying direction, and the de-curling means is arranged at the downstream side of the second conveying roller as being faced to a space between the rollers of the second conveying roller.

4. The sheet storing apparatus according to claim 3, wherein the de-curling means has a width to cover the space between the rollers of the second conveying roller in the direction perpendicular to the conveying direction.

5. The sheet storing apparatus according to claim 4, wherein the de-curling means has a width being approximately the same as that of a roller engagement portion of the second conveying roller in the direction perpendicular to the sheet conveying direction.

6. The sheet storing apparatus according to claim 1, wherein the de-curling means is structured with a guide member which has a guide face to correct a corrugation of a sheet discharged from the second conveying roller to be flat, and the guide member is arranged as hanging from the second sheet discharging port to a sheet placement face of the stack tray.

7. The sheet storing apparatus according to claim 6, wherein an idling roller to reduce engagement friction against a sheet is arranged at the guide face.

8. The sheet storing apparatus according to claim 6, wherein the second conveying roller includes a lower roller which is arranged at the processing tray and an upper roller which is lifted and lowered between an operating position to be pressure-contacted to the lower roller and a waiting position to be apart from the lower roller, and lifting means which performs lifting and lowering between the operating position and the waiting position is arranged at the upper roller.

9. The sheet storing apparatus according to claim 8, wherein the guide member which structures the de-curling means is lifted and lowered by the lifting means integrally with the upper roller.

10. The sheet storing apparatus according to claim 1, wherein controlling means which controls the first and second conveying rollers provides a sheet discharging operation to convey a sheet conveyed to the first sheet discharging port to the processing tray as reversing conveyance in direction, and a second sheet discharging operation to convey a sheet conveyed to the first sheet discharging port to the stack tray located at the front side in a sheet discharging direction.

11. The sheet storing apparatus according to claim 10, wherein stapling means which performs a binding process on a sheet conveyed from the first sheet discharging port is arranged at the processing tray.

12. A sheet storing apparatus in which a sheet is stored at a stack tray via a first conveying roller which discharges a sheet and a second conveying roller which is arranged at the downstream side of the first conveying roller, comprising:

corrugation forming means which forms a plurality of corrugations aligned in a direction perpendicular to a conveying direction on a sheet proceeding from the first conveying roller to the second conveying roller; and de-curling means which is arranged between the second conveying roller and a sheet placement face of the stack tray to correct the corrugation formed on a sheet to be flat, so that the number of corrugations of a sheet proceeding from the second conveying roller to the stack tray is smaller than the number of corrugations of a sheet proceeding from the first conveying roller to the second conveying roller.

* * * * *